US011111121B2

(12) United States Patent
Nakamoto et al.

(10) Patent No.: US 11,111,121 B2
(45) Date of Patent: Sep. 7, 2021

(54) CONVEYANCE APPARATUS

(71) Applicant: KABUSHIKI KAISHA TOSHIBA, Minato-ku (JP)

(72) Inventors: Hideichi Nakamoto, Setagaya (JP); Junichiro Ooga, Kawasaki (JP); Hiroshi Takahashi, Yokohama (JP); Takamitsu Sunaoshi, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/802,245

(22) Filed: Feb. 26, 2020

(65) Prior Publication Data

US 2021/0070594 A1 Mar. 11, 2021

(30) Foreign Application Priority Data

Sep. 10, 2019 (JP) ..... JP2019-164913

(51) Int. Cl.
*B66F 9/075* (2006.01)
*B66F 9/12* (2006.01)

(52) U.S. Cl.
CPC ..... *B66F 9/12* (2013.01); *B66F 9/07559* (2013.01)

(58) Field of Classification Search
CPC .... B66F 9/07563; B66F 9/10; B66F 9/07559; B66F 9/07581; B66F 9/06; B62D 57/022; B62D 57/04; B62B 3/0643; B62B 5/025
See application file for complete search history.

(56) References Cited

U.S. PATENT DOCUMENTS 6,027,303 A * 2/2000 Voegeli ..... B66F 9/06 414/401
8,376,089 B2 * 2/2013 Stone ..... B66F 9/06 187/232
9,045,320 B2 * 6/2015 Turrini ..... B60P 3/1091
2005/0042068 A1 * 2/2005 Ehmen ..... B66F 9/06 414/661
2017/0285644 A1 10/2017 Ichinose et al.
2020/0307974 A1 * 10/2020 Hasegawa ..... B66F 9/10

FOREIGN PATENT DOCUMENTS

JP 2005-29082 2/2005
JP 2017-178567 A 10/2017

* cited by examiner

*Primary Examiner* — Mark C Hageman
(74) *Attorney, Agent, or Firm* — Oblon, McClelland, Maier & Neustadt, L.L.P.

(57) ABSTRACT

A conveyance apparatus according to an embodiment includes a fork unit, a lift unit, a movable cart unit, an auxiliary leg, and a distal end support mechanism. The lift unit is configured to drive the fork unit upward and downward. The movable cart unit is configured to support the lift unit and be movable on a traveling surface by driving a drive wheel. The auxiliary leg unit is provided for the movable cart unit, and is movable along a longitudinal direction of the fork unit and having an auxiliary wheel a position of which is changeable relative to the movable cart unit. The distal end support mechanism is provided on a distal end side of the fork unit and is switchable between a non-contact state with the traveling surface and a contact state with the traveling surface.

9 Claims, 21 Drawing Sheets

CONVEYANCE APPARATUS

CROSS-REFERENCE TO RELATED APPLICATIONS

This application is based upon and claims the benefit of priority from Japanese Patent Application No. 2019-164913, filed on Sep. 10, 2019; the entire contents of which are incorporated herein by reference.

FIELD

Embodiments described herein relate generally to a conveyance apparatus.

BACKGROUND

An unmanned forklift is known as a conveyance apparatus which realizes labor saving of an operation for conveying a load. However, the unmanned forklift adopts the structure where a large counterweight is arranged on a vehicle body side to prevent the forklift from losing its balance due to the weight of the load lifted by a fork unit. Accordingly, upsizing of the apparatus is unavoidable.

On the other hand, as a conveyance apparatus such as a hand lifter operated by an operator, there has been also known a conveyance apparatus for which auxiliary wheels provided on a distal end side of a fork unit are brought into contact with a traveling surface so that the weight of a load can be supported on a fork unit side. Since such a conveyance apparatus does not require a counterweight, the conveyance apparatus can have a compact configuration.

However, a compact conveyance apparatus such as a hand lifter has a structure that is designed on a premise that the operation is performed by an operator. As such, making such a conveyance apparatus unmanned with this structure as is, is difficult. In particular, unmanned operation of lifting a load high or getting over a stepped portion (i.e., a level difference) of the traveling surface is unfeasible by a conveyance apparatus having a structure where a load is supported by bringing an auxiliary wheel of a distal end side of the fork unit into contact with a traveling surface.

DETAILED DESCRIPTION

A conveyance apparatus according to an embodiment includes a fork unit, a lift unit, a movable cart unit, an auxiliary leg, and a distal end support mechanism. The lift unit is configured to drive the fork unit upward and downward. The movable cart unit is configured to support the lift unit and be movable on a traveling surface by driving a drive wheel. The auxiliary leg unit is provided for the movable cart unit, and is movable along a longitudinal direction of the fork unit and having an auxiliary wheel a position of which is changeable relative to the movable cart unit. The distal end support mechanism is provided on a distal end side of the fork unit and is switchable between a non-contact state with the traveling surface and a contact state with the traveling surface. Hereinafter, a conveyance apparatus of an embodiment will be described in detail with reference to accompanying drawings. In the schematic diagrams among the attached drawings, respective parts which form the conveyance apparatus are illustrated in a simplified manner for facilitating the understanding of the drawings. Accordingly, it should be noted that the shapes, the sizes, the arrangement and the like of the respective parts are not necessarily accurately illustrated.

Figure 1:
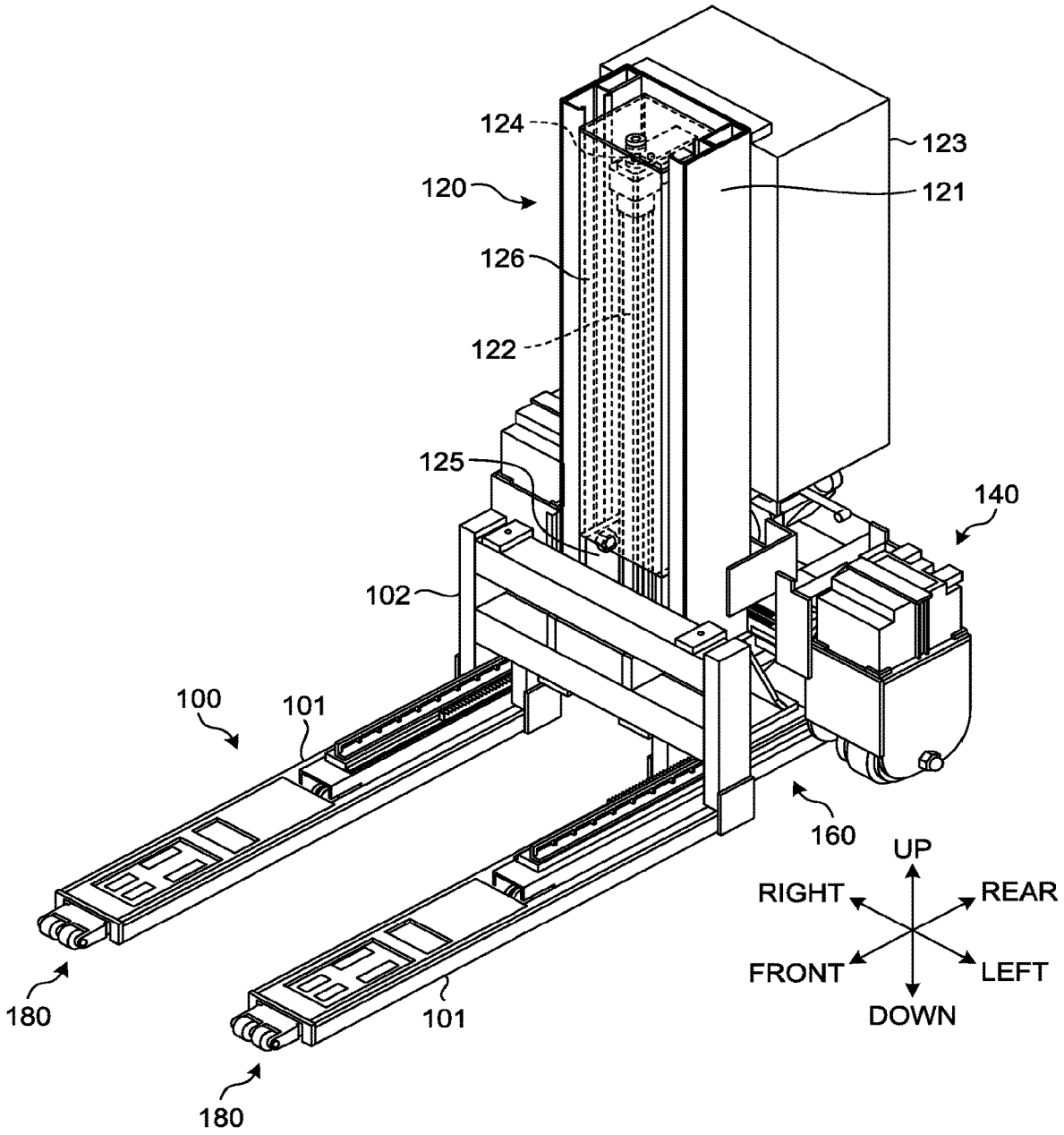
FIG. 1 is a perspective diagram illustrating the overall configuration of a conveyance apparatus according to an embodiment.
Figure 2:
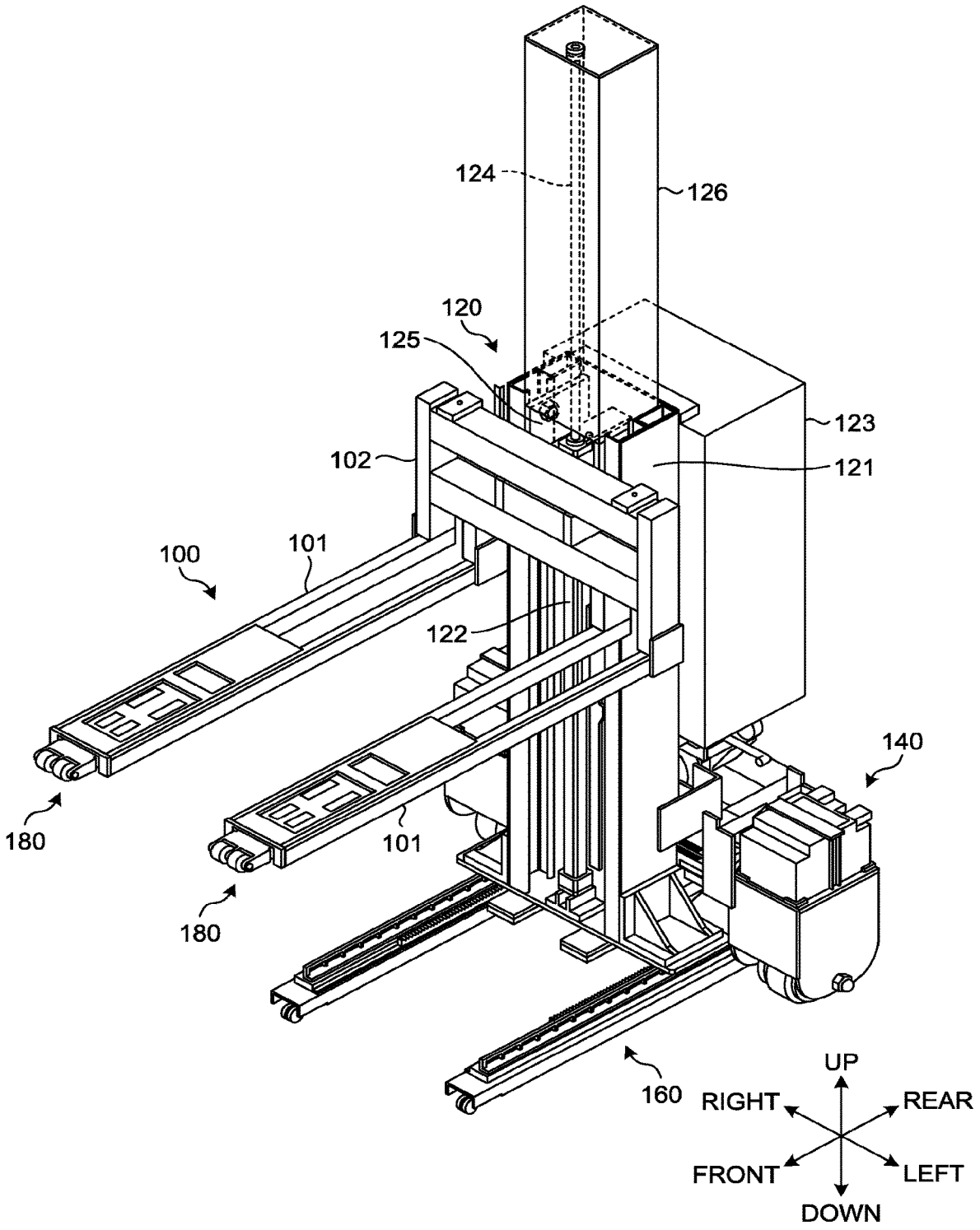
FIG. 2 is a perspective diagram illustrating the overall configuration of the conveyance apparatus of the embodiment.

First, the mechanical configuration of the conveyance apparatus according to the embodiment will be described. FIGS. 1 and 2 are perspective diagrams illustrating the overall configuration of the conveyance apparatus of the embodiment. As illustrated in FIGS. 1 and 2, the conveyance apparatus of the embodiment includes a fork unit 100, a lift unit 120, a movable cart unit 140, an auxiliary leg unit 160, and distal end support mechanisms 180. Note that the front, rear, left, right, up, and down directions of the conveyance apparatus are exactly as illustrated in the drawings.

The fork unit 100 supports a load (a pallet and a stacked article stacked on the pallet) which the conveyance apparatus conveys. The fork unit 100 has the configuration in which a pair of left and right claws 101 is held by a holder 102. With respect to a pair of the claws 101, a distal end side of each of the claws 101 is positioned in the longitudinal direction on a front side of the conveyance apparatus, and a proximal end side of each of the claws 101 is fixed to the holder 102. The holder 102 is connected to a connecting member 125 described later. A distance between the pair of claws 101 is determined to be equal to the distance between the pallet fork insertion holes. The pair of claws 101 may have a structure where the pair of claws 101 is mounted on the holder 102 such that the distance between the pair of claws 101 can be adjusted.

The lift unit 120 is provided for driving the fork unit 100 upward and downward. The lift unit 120 is formed such that a hydraulic cylinder 122 is disposed in a frame 121 which is erected in the vertical direction. A tank 123 is mounted on the frame 121. The tank 123 stores working oil used for operating the hydraulic cylinder 122.

When working oil is supplied from the tank 123 to the hydraulic cylinder 122 by driving a hydraulic motor, a pressure in the hydraulic cylinder 122 is increased so that a piston rod 124 is pushed up by the pressure. The piston rod 124 is connected to the connecting member 125 to which the holder 102 of the fork unit 100 is connected. With such a structure, when the hydraulic cylinder 122 is driven, the piston rod 124 is pushed up so that fork unit 100 is lifted (see FIG. 2). Further, when the working oil in the hydraulic cylinder 122 is recovered in the tank 123, a pressure in the hydraulic cylinder 122 is decreased and hence, the piston rod 124 is pushed down by the weight of the fork unit 100 whereby the fork unit 100 is lowered (see FIG. 1).

A cylindrical protective cover 126 which moves integrally with the piston rod 124 is provided above the connecting member 125. The periphery of the piston rod 124 which is pushed up by driving the hydraulic cylinder 122 is covered by the protective cover 126 and hence, the piston rod 124 is protected (see FIG. 2).

Figure 3:
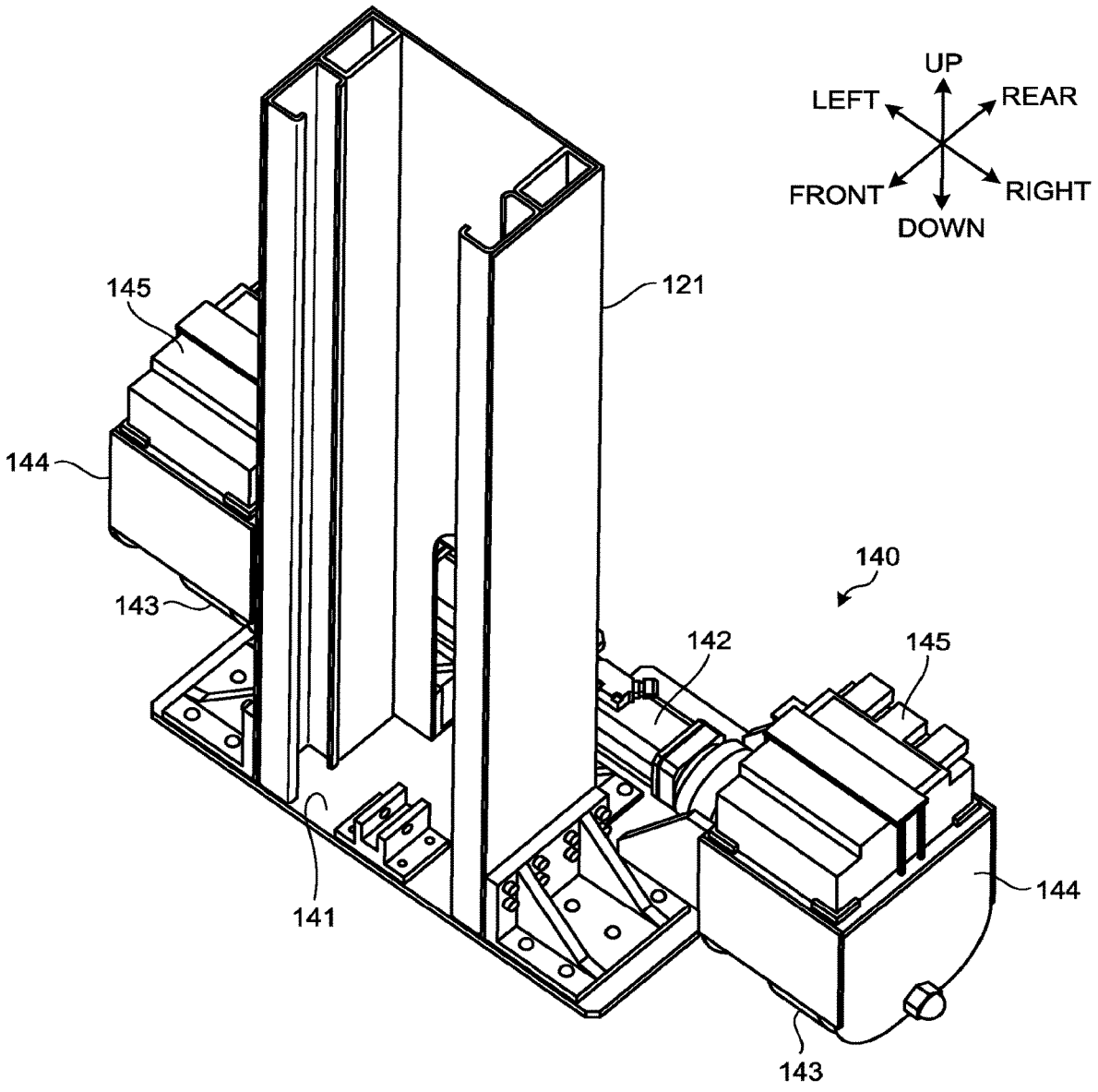
FIG. 3 is a perspective diagram illustrating details of a movable cart unit.

The movable cart unit 140 is a moving body which supports the lift unit 120. The details of the movable cart unit 140 are illustrated in FIG. 3. As illustrated in FIG. 3, the movable cart unit 140 includes a pedestal 141 to which the frame 121 of the lift unit 120 is fixed, a pair of drive motors 142 disposed on the pedestal 141, and a pair of left and right drive wheels 143 which is connected to output shafts of the pair of drive motors 142 to each other via reduction gears respectively. The movable cart unit 140 can move straight or turn on the traveling surface by driving the pair of left and right drive wheels 143 with a control of the pair of drive motors 142.

Upper sides of the pair of left and right drive wheels 143 are covered by wheel covers 144 which are fixed to the pedestal 141 respectively. On the wheel covers 144, batteries 145 which are used as a power source for the entire conveyance apparatus are disposed. With such a configuration, a horizontal projection area of the movable cart unit 140 can be reduced.

Figure 4A:
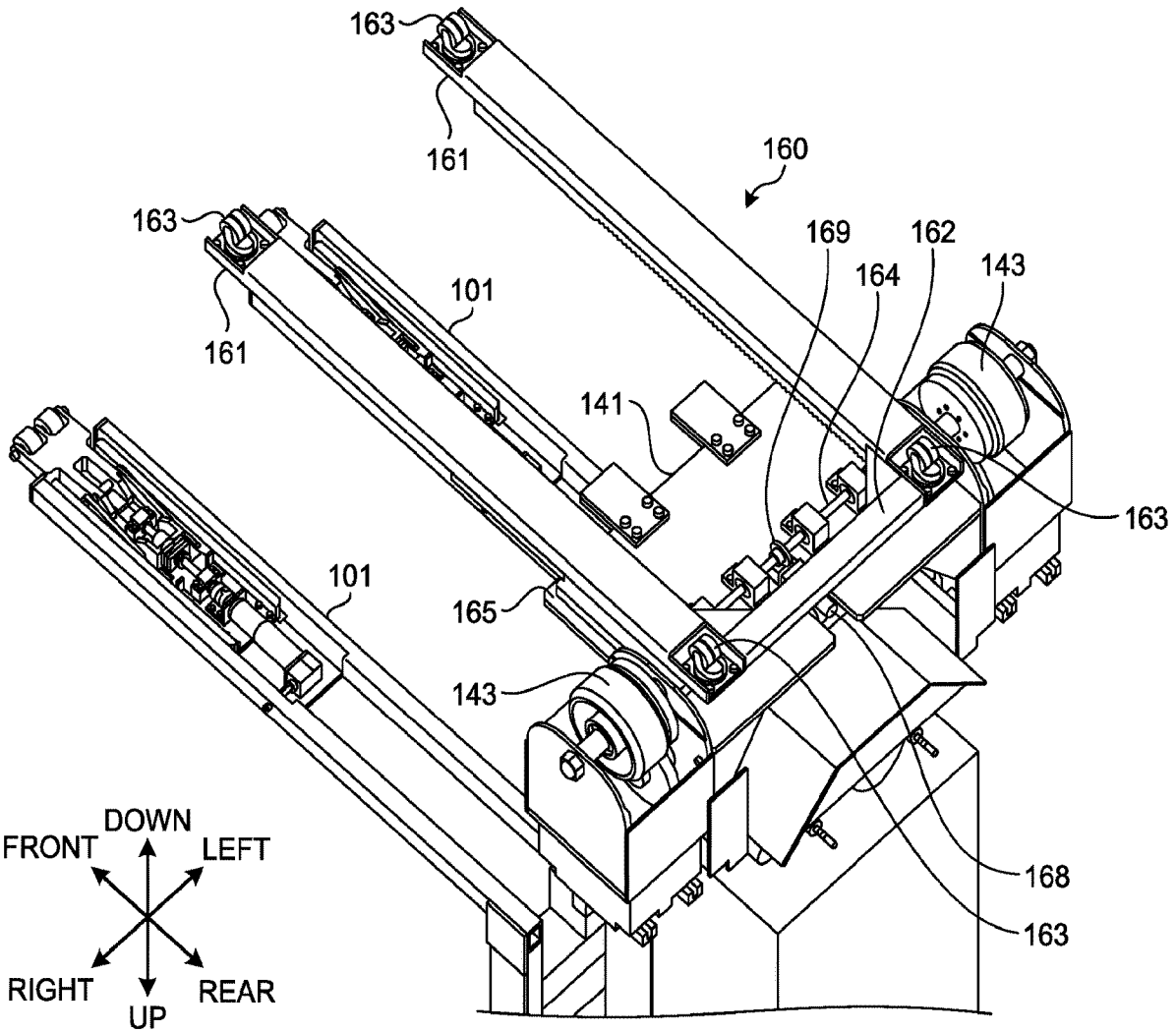
FIG. 4A is a perspective diagram illustrating details of an auxiliary leg unit.
Figure 4B:
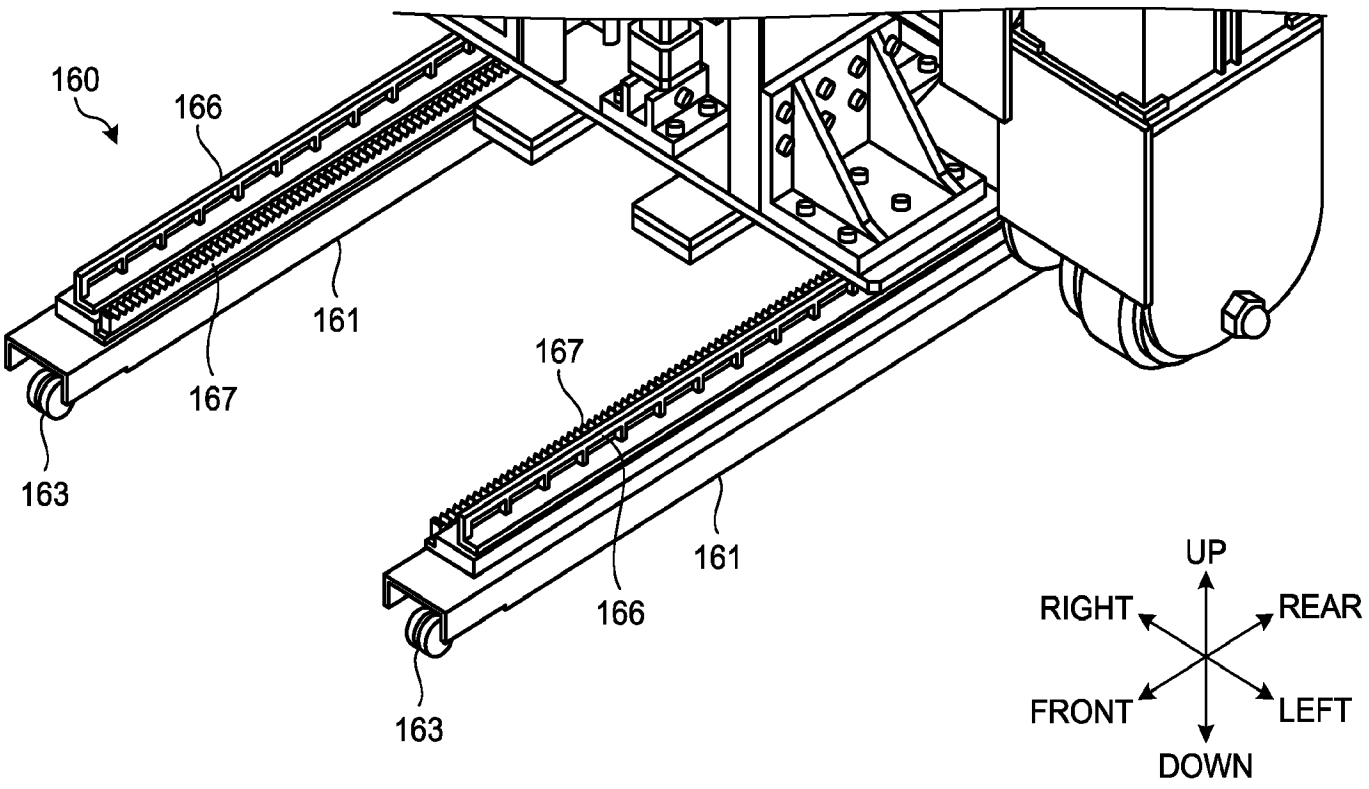
FIG. 4B is a perspective diagram illustrating details of the auxiliary leg unit.
Figure 4C:
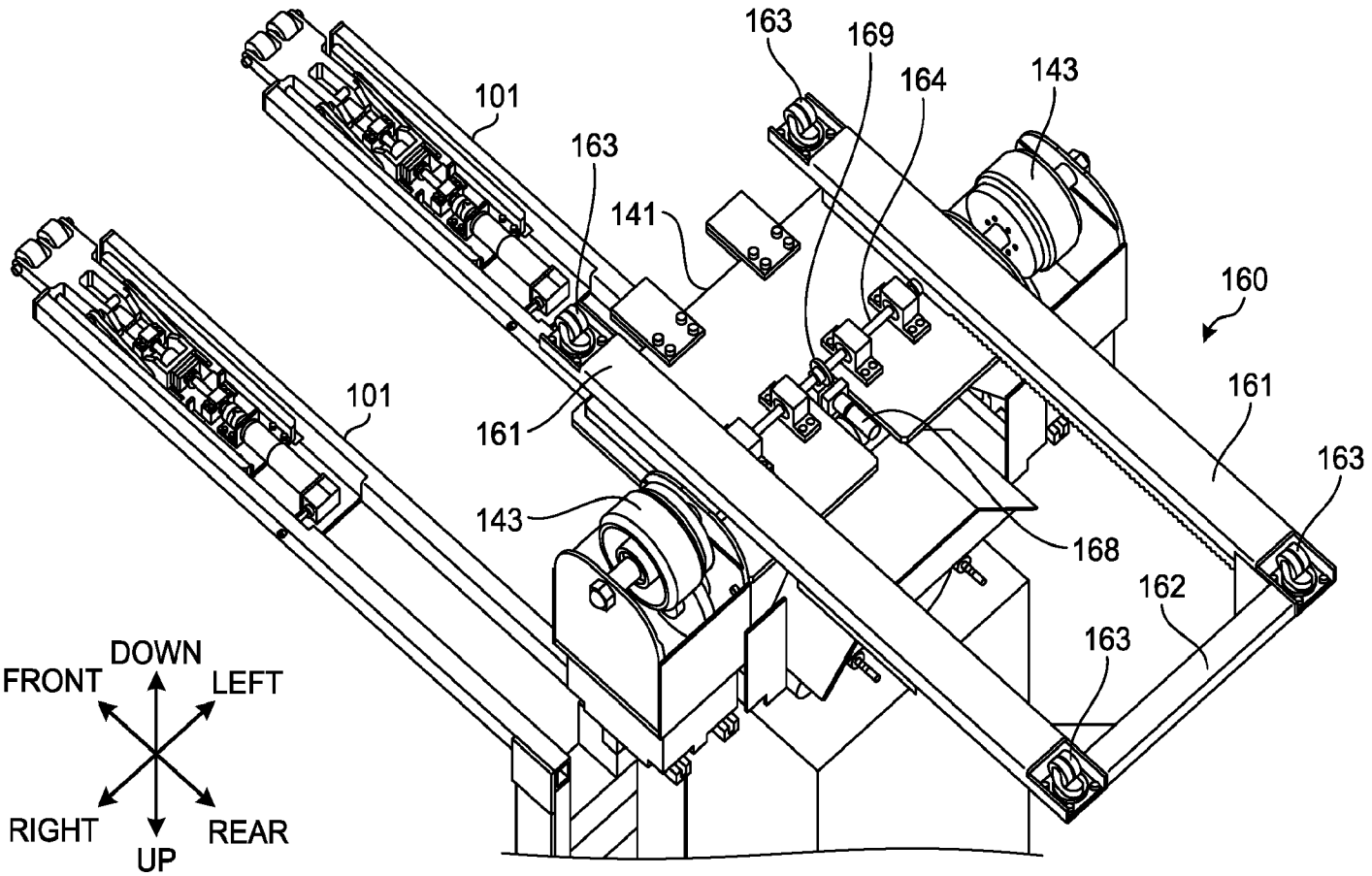
FIG. 4C is a perspective diagram illustrating details of the auxiliary leg unit.

The auxiliary leg unit 160 is a structural body which is connected to the movable cart unit 140 so as to be movable along the longitudinal direction of the claws 101 of the fork unit 100 (that is, the front-rear direction of the conveyance apparatus). Details of the auxiliary leg unit 160 are illustrated in FIGS. 4A to 4C. FIGS. 4A and 4C illustrate a state where the auxiliary leg unit 160 is viewed from a lower side of the conveyance apparatus, and FIG. 4B illustrates a state where the auxiliary leg unit 160 is viewed from an upper side of the conveyance apparatus.

As illustrated in FIGS. 4A and 4C, the auxiliary leg unit 160 has a structure in which a pair of left and right auxiliary legs 161 is connected to each other by a connecting portion 162. The auxiliary leg unit 160 is formed such that a distance between the pair of left and right auxiliary legs 161 is substantially equal to a distance between the pair of claws 101 of the fork unit 100. The auxiliary leg unit 160 is disposed on a back surface side of the pedestal 141 of the movable cart unit 140 (a side of the pedestal 141 disposed opposite to a surface of the pedestal 141 to which the frame 121 of the lift unit 120 is fixed) such that the pair of auxiliary legs 161 overlaps with the pair of claws 101 as viewed in the vertical direction.

Auxiliary wheels 163 which are brought into contact with a traveling surface are provided on distal end sides (front sides of the conveyance apparatus) of the pair of auxiliary legs 161 and proximal end sides (rear sides of the conveyance apparatus) of the pair of auxiliary legs 161 which are connected to the connecting portion 162. The auxiliary leg unit 160 functions as supporting the weight of the conveyance apparatus in a distributed manner without concentrating the weight of the conveyance apparatus on the drive wheels 143 of the movable cart unit 140 by bringing these four auxiliary wheels 163 into contact with the traveling surface. It is sufficient that the auxiliary wheels 163 which is brought into contact with the traveling surface are provided at least on the distal end sides (front sides) of the pair of auxiliary legs 161, and the auxiliary wheels 163 disposed on the proximal end sides (rear sides) of the pair of auxiliary legs 161 may not be brought into contact with the traveling surface.

Further, it is desirable that the auxiliary leg unit 160 include a brake mechanism which suppresses the rotation of the auxiliary wheel 163. For example, brake modules may be mounted on the auxiliary leg unit 160. The brake module is configured to suppress the rotation of the auxiliary wheel 163 by pressing a friction plate which moves by an electromagnetic force to a disk fixed to a rotary shaft of the auxiliary wheel 163.

On the back side of the pedestal 141 of the movable cart unit 140, a rotary shaft 164 having pinions attached to both ends is arranged along the left-right direction of the conveyance apparatus. Further, linear motion (LM) blocks 165 are disposed on the back side of the pedestal 141. The linear motion (LM) blocks 165 are positioned near both ends of the rotary shaft 164 and engage with linear rails 166 described later. On the other hand, as illustrated in FIG. 4B, the pair of auxiliary legs 161 of the auxiliary leg unit 160 is provided with: the linear rails 166 which engage with the LM blocks 165 along the longitudinal direction (front-rear direction of the conveyance apparatus); and racks 167 which engage with pinions mounted on both ends of the rotary shafts 164.

The rotary shaft 164 disposed on the back side of the pedestal 141 rotates when the power of an auxiliary leg moving motor 168 is transmitted by way of a worm gear and a worm wheel 169. The rotation of the rotary shaft 164 is converted into a linear motion of the auxiliary leg unit 160 by the pinions and the racks 167, and the auxiliary leg unit 160 moves in the front-rear direction while being guided by the LM blocks 165 and the linear rails 166. That is, by controlling the auxiliary leg moving motor 168, the auxiliary leg unit 160 is movable in the front-rear direction as illustrated in FIGS. 4A and 4C and hence, the relative position of the auxiliary wheels 163 which are brought into contact with the traveling surface relative to the movable cart unit 140 can be changed.

The power of an auxiliary leg moving motor 168 is transmitted to the rotary shaft 164 by way of the worm gear and the worm wheel 169. With such a configuration, it is possible to effectively suppress the auxiliary leg unit 160 from making unexpected movement due to an external force or the like when the auxiliary leg moving motor 168 is not operating. As a result, it is possible to increase the stability of the conveyance apparatus thus preventing the vehicle from being overturned.

Figure 5A:
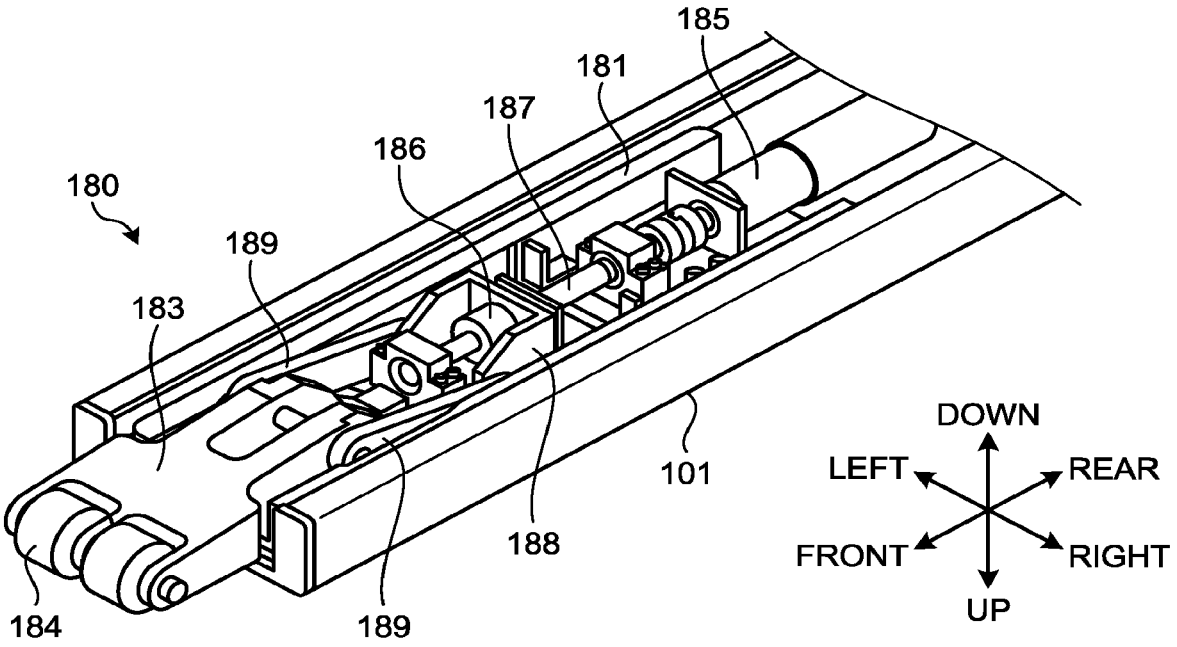
FIG. 5A is a perspective diagram illustrating details of a distal end support mechanism.
Figure 5B:
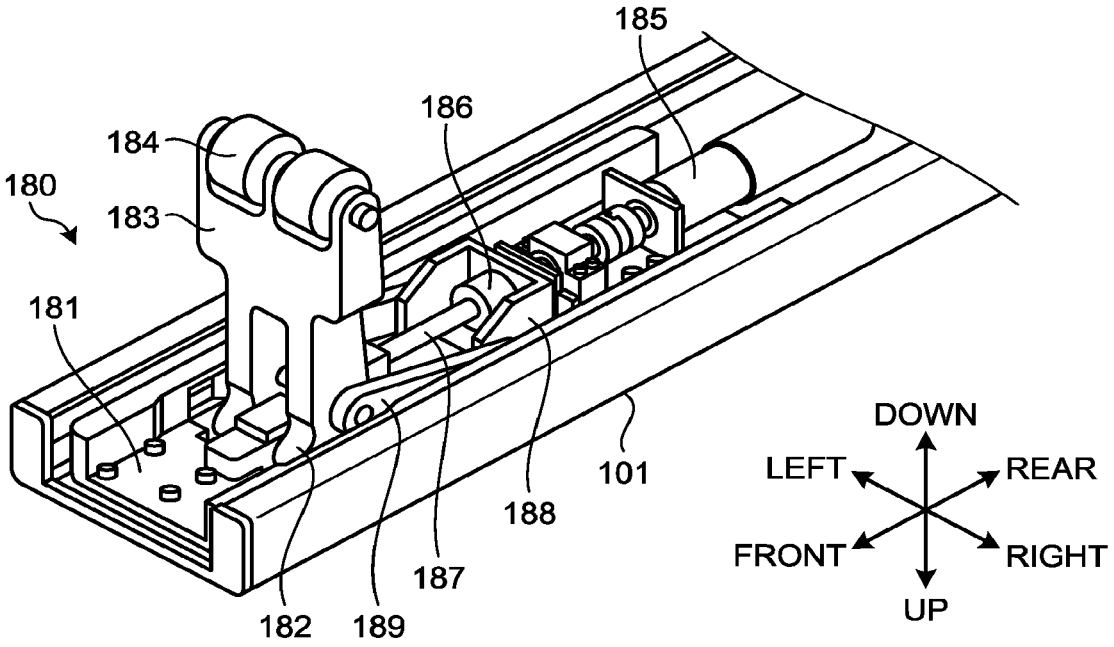
FIG. 5B is a perspective diagram illustrating details of the distal end support mechanism.

The distal end support mechanism 180 is provided on each of the distal ends of the pair of claws 101 of the fork unit 100. The distal end support mechanism 180 has a mechanism that is switchable between a non-contact state with the traveling surface and a contact state with the traveling surface. Details of the distal end support mechanism 180 are illustrated in FIGS. 5A and 5B. FIGS. 5A and 5B illustrate a state where the distal end support mechanism 180 is viewed from the lower side of the conveyance apparatus.

As illustrated in FIGS. 5A and 5B, the distal end support mechanism 180 includes: a holder 181 which is housed on the back side of the claw 101 of the fork unit 100; and a distal end arm 183 where a proximal end of the distal end arm 183 is inserted into a rotary shaft 182 fixed to the holder 181 and the distal end arm 183 is rotatably supported by the holder 181 about an axis of the rotary shaft 182. A wheel 184 is provided on the distal end side of the distal end arm 183.

A ball screw 187 which is inserted into a nut 186 is connected to an output shaft of a distal end support drive motor 185. The distal end support drive motor 185 is provided as a power source for rotating the distal end arm 183. A nut link 188 is fixed to the nut 186, and the nut link 188 and the distal end arm 183 are connected to each other by way of a relay link 189. One end side of the relay link 189 is connected to the nut link 188 by a free joint, and the other end side of the relay link 189 is connected to the distal end arm 183 by a free joint.

When the ball screw 187 is rotated by driving the distal end support drive motor 185, the nut 186 and the nut link 188 are linearly moved in the axial direction of the ball screw 187. When the nut link 188 moves linearly, the power of the nut link 188 is transmitted to the distal end arm 183 by way of the relay link 189, and the distal end arm 183 rotates about the axis of the rotary shaft 182. That is, by controlling the distal end support drive motor 185, the posture of the distal end arm 183 of the distal end support mechanism 180 is changed between a state where the distal end arm 183 is laid down in parallel to the claw 101 of the fork unit 100 as illustrated in FIG. 5A and a state where the distal end arm 183 is raised vertically with respect to the claw 101 of the fork unit 100 as illustrated in FIG. 5B. Although the distal end arm 183 is not brought into contact with the traveling surface in a state illustrated in FIG. 5A, the distal end arm 183 can be brought into contact with the traveling surface by way of the wheel 184 in a state illustrated in FIG. 5B.

Figure 6:
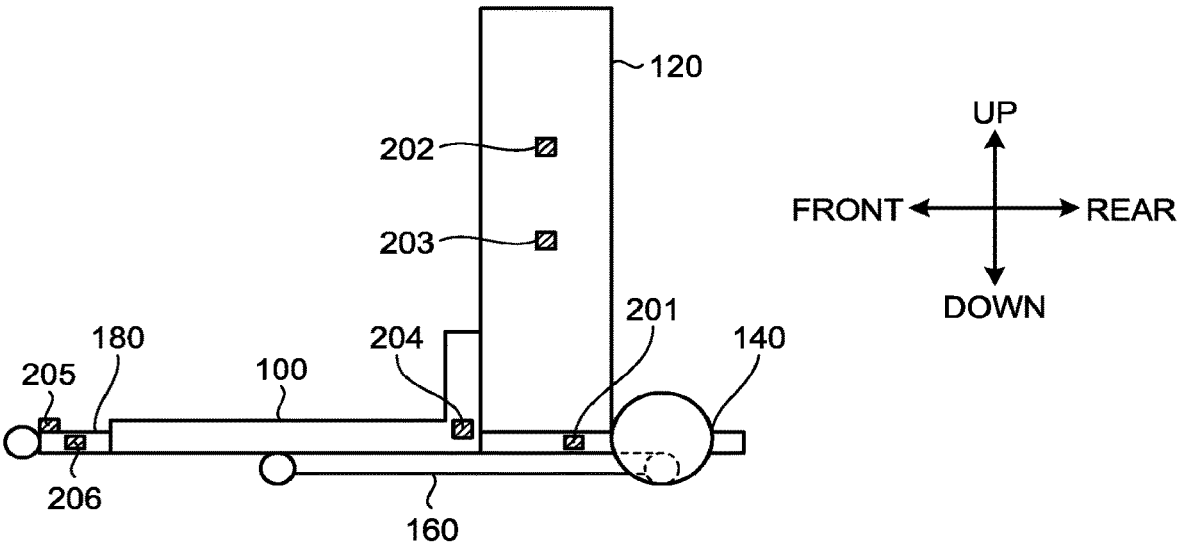
FIG. 6 is a schematic diagram illustrating an arrangement example of various sensors included in the conveyance apparatus of the embodiment.

Next, the configuration of a control system of the conveyance apparatus according to the embodiment will be described. FIG. 6 is a schematic diagram illustrating an arrangement example of various sensors which the conveyance apparatus of the embodiment includes. As illustrated in FIG. 6, the conveyance apparatus of the embodiment includes an acceleration sensor 201, an inclination sensor 202, a pressure sensor 203, a load sensor 204, a camera 205, and a distance sensor 206.

The acceleration sensor 201 is provided on the movable cart unit 140, for example, and detects acceleration and deceleration (movement acceleration/deceleration) of the movable cart unit 140 when the movable cart unit 140 moves. The inclination sensor 202 is provided on the lift unit 120, for example, and detects the inclination of the conveyance apparatus.

The pressure sensor 203 indirectly detects the weight of a load which the fork unit 100 supports by detecting a pressure in the hydraulic cylinder 122 of the lift unit 120. The load sensor 204 is provided on the fork unit 100 and directly detects the weight of a load. The pressure sensor 203 and the load sensor 204 are an example of a load weight detection unit which detects the weight of a load which the fork unit 100 supports.

The camera 205 is provided on the distal end support mechanism 180, for example, and picks up an anterior image of the conveyance apparatus. The distance sensor 206 is provided on the distal end support mechanism 180, for example, and measures distances from the distance sensor 206 to various objects in front of the conveyance apparatus. The images captured by the camera 205 and the distance information measured by the distance sensor 206 are examples of anterior (i.e. front) information indicative of an anterior state of the conveyance apparatus, and the camera 205 and the distance sensor 206 are an example of an acquisition unit which acquires the anterior information.

Figure 7:
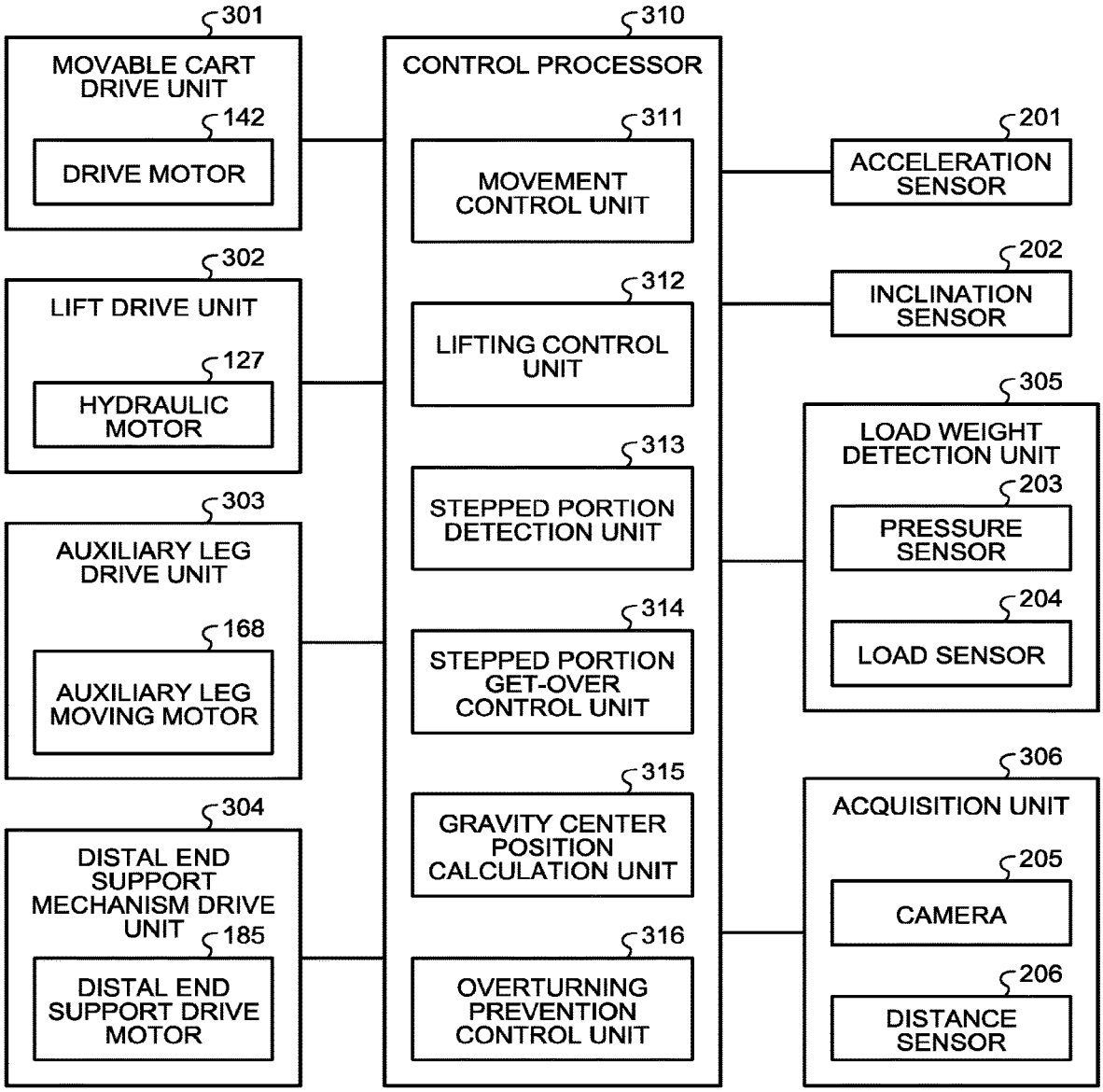
FIG. 7 is a block diagram illustrating a configuration example of a control system of the conveyance apparatus according to the embodiment.

FIG. 7 is a block diagram illustrating a configuration example of a control system of the conveyance apparatus according to the embodiment. As illustrated in FIG. 7, the control system of the conveyance apparatus includes a movable cart drive unit 301 which drives the movable cart unit 140; a lift drive unit 302 which drives the lift unit 120; an auxiliary leg drive unit 303 which drives the auxiliary leg unit 160; a distal end support mechanism drive unit 304 which drives the distal end support mechanism 180; and a control processor 310 which controls operations of the respective units. The movable cart drive unit 301 includes the above-described drive motor 142. The lift drive unit 302 includes an above-described hydraulic motor 127. The auxiliary leg drive unit 303 includes the above-described auxiliary leg moving motor 168. The distal end support mechanism drive unit 304 includes the above-described distal end support drive motor 185.

The acceleration sensor 201, the inclination sensor 202, a load weight detection unit 305 which includes the pressure sensor 203 and the load sensor 204, and an acquisition unit 306 which includes the camera 205 and the distance sensor 206 are connected to a control processor 300 respectively.

The control processor 310 is formed of a general-purpose processor such as a central processing unit (CPU), for example. As illustrated in FIG. 7, the control processor 310 allows a movement control unit 311, a lifting control unit 312, a stepped portion detection unit 313, a stepped portion get-over control unit 314, a gravity center position calculation unit 315, an overturning prevention control unit 316 and the like to perform various functions by performing various arithmetic operations in accordance with a predetermined control program. The control processor 310 may be configured using a dedicated hardware such as an application specific integrated circuit (ASIC) or a field-programmable gate array (FPGA) in which these control functions are implemented.

The movement control unit 311 controls the movement of the movable cart unit 140 on the traveling surface by outputting a control command to the movable cart drive unit 301 based on the anterior information acquired by the acquisition unit 306 (an image captured by the camera 205 and the distance information measured by the distance sensor 206). To lift a load such as a pallet by the lift unit 120 while maintaining a balance by supporting the load by the fork unit 100, the lifting control unit 312 controls the operations of the lift unit 120, the distal end support mechanism 180 and the auxiliary leg unit 160 by outputting control commands to the lift drive unit 302, the distal end support mechanism drive unit 304, and the auxiliary leg drive unit 303.

The stepped portion detection unit 313 detects a stepped portion (i.e. a level difference) of the traveling surface on which the movable cart unit 140 moves based on the anterior information acquired by the acquisition unit 306 (an image captured by the camera 205 and the distance information measured by the distance sensor 206). The stepped portion get-over control unit 314 controls operations of the distal end support mechanism 180 and the auxiliary leg unit 160 by outputting control commands to the distal end support mechanism drive unit 304 and the auxiliary leg drive unit 303 such that the movable cart unit 140 gets over the stepped portion detected by the stepped portion detection unit 313.

The gravity center position calculation unit 315 calculates the position of the center of gravity of the conveyance apparatus which conveys a load based on the weight of the load detected by the load weight detection unit 305. The overturning prevention control unit 316 determines whether or not the movable cart unit 140 overturns when the conveyance apparatus conveys the load based on the position of the center of gravity calculated by the gravity center position calculation unit 315 and the movement acceleration/deceleration of the movable cart unit 140 is set in advance. When the overturning prevention control unit 316 determines that the conveyance apparatus overturns, the overturning prevention control unit 316 performs a control so as to prevent the overturning of the conveyance apparatus. Such a control to prevent the overturning of the conveyance apparatus is, for example, a control where the distal end support mechanism 180 which is not in contact with the traveling surface is brought into contact with the traveling surface, a control where the auxiliary leg unit 160 is moved so as to bring the auxiliary wheel 163 on the rear side into contact with a traveling surface 400 behind the drive wheel 143, or a control where the movement acceleration/deceleration of the movable cart unit 140 is reduced.

Since the conveyance apparatus of the embodiment has the above-described structure and control system, the conveyance apparatus can perform various operations necessary for conveying loads in an unmanned state. Hereinafter, among the operations of the conveyance apparatus of embodiment, the main operations are described.

First, with reference to FIGS. 8A to 8E, a pallet lifting operation by the conveyance apparatus of the embodiment will be described. FIGS. 8A to 8E are schematic diagrams illustrating the pallet lifting operation.

Figure 8A:
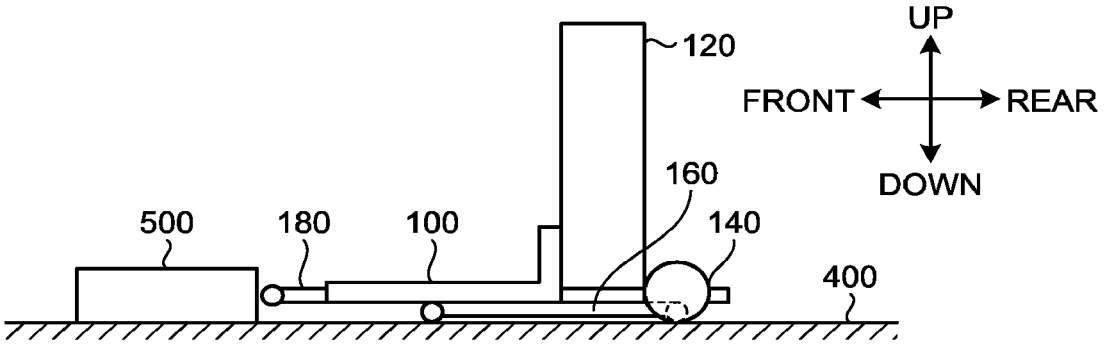
FIG. 8A is a schematic diagram illustrating a pallet lifting operation.
Figure 8B:
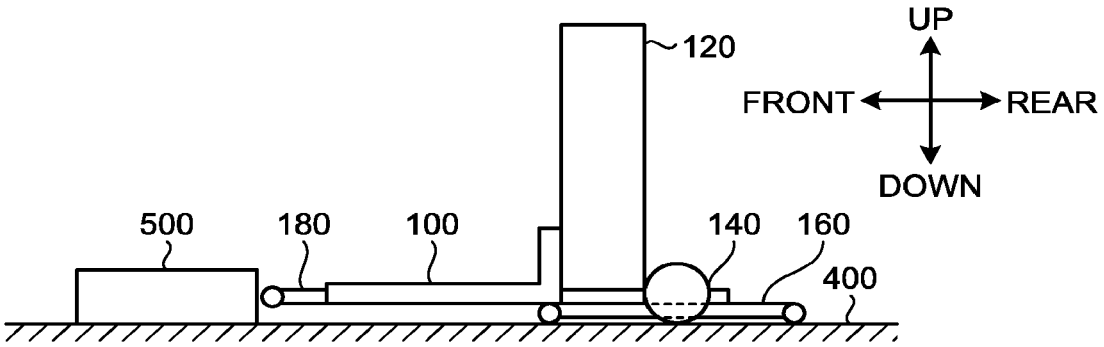
FIG. 8B is a schematic diagram illustrating the pallet lifting operation.
Figure 8C:
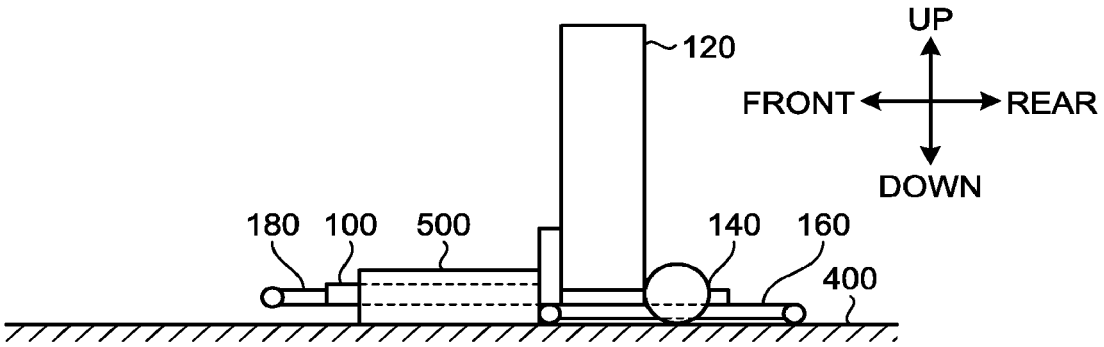
FIG. 8C is a schematic diagram illustrating the pallet lifting operation.

The conveyance apparatus reaches a position immediately in front of a pallet 500 along with the movement of the movable cart unit 140 on the traveling surface 400, and temporarily stops immediately in front of the pallet 500 (see FIG. 8A). Then, the auxiliary leg unit 160 is moved rearward just in front of the pallet 500, (see FIG. 8B).

Thereafter, the movable cart unit 140 is moved forward so that the fork unit 100 is inserted into the fork insertion hole of the pallet 500. The movable cart unit 140 is stopped when a distal end of the fork unit 100 goes through the pallet 500 (see FIG. 8C). At this stage of the operation, the auxiliary leg unit 160 is moved rearward and hence, the auxiliary leg unit 160 does not interfere with the pallet 500.

Figure 8D:
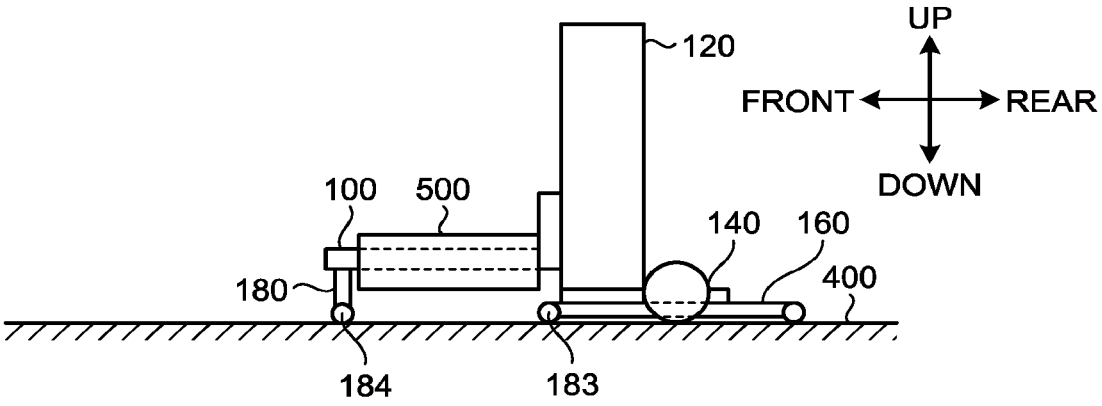
FIG. 8D is a schematic diagram illustrating the pallet lifting operation.

Next, the distal end support mechanisms 180 are driven so as to bring the wheels 184 into contact with the traveling surface 400, and the fork unit 100 is lifted by the lift unit 120 (see FIG. 8D). Thereby, the weight of the pallet 500 can be received on a distal end side of the fork unit 100. In addition, the fork unit 100 which supports the pallet 500 can be maintained in a horizontal state by performing the operation of the distal end support mechanism 180 and the operation of lifting the fork unit 100 by the lift unit 120 in a linked manner. The operation of the lift unit 120 which lifts the fork unit 100 in a linked manner with the distal end support mechanism 180 may be an operation which is performed in accordance with an operation pattern calculated in advance as an operation to maintain the fork unit 100 in a horizontal state. Alternatively, such an operation of the lift unit 120 may be an operation where the fork unit 100 is lifted so as to assume a horizontal state while monitoring an output of the inclination sensor 202.

Figure 8E:
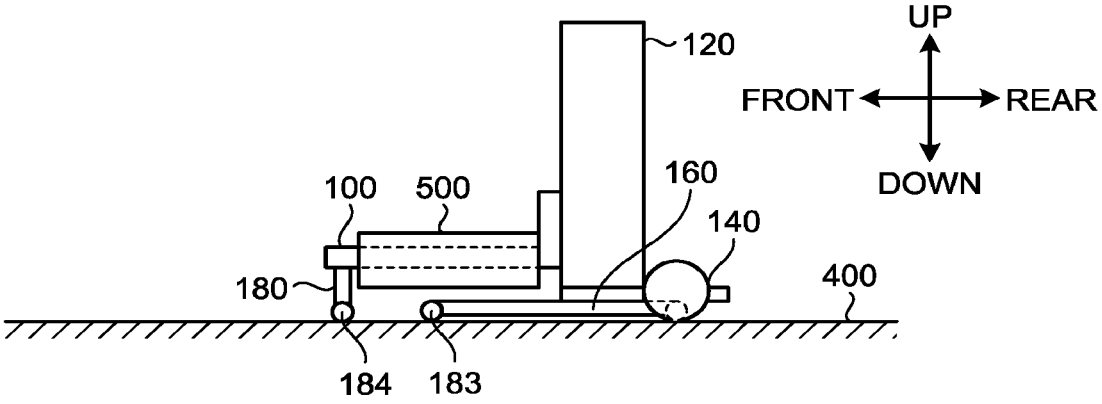
FIG. 8E is a schematic diagram illustrating the pallet lifting operation.

Finally, the auxiliary leg unit 160 is moved forward in a state where the wheels 184 of the distal end support mechanisms 180 are brought into contact with the traveling surface 400 (see FIG. 8E). Accordingly, the positions where the auxiliary wheels 163 disposed on the front side of the auxiliary leg units 160 are brought into contact with the traveling surface 400 are located below the pallet 500 supported by the fork unit 100. Accordingly, the weight of the conveyance apparatus biased toward a front side by the weight of the pallet 500 can be received by the auxiliary wheels 163 disposed on the front sides of the auxiliary leg units 160.

Then, when the conveyance apparatus travels on the traveling surface 400 (the movable cart unit 140 moves) in a state where the pallet 500 is lifted, the distal end support mechanisms 180 may be returned to an original state where the wheels 184 are not in contact with the traveling surface 400. Further, the conveyance apparatus may travel on the traveling surface 400 in a state where the lift unit 120 lowers the fork unit 100 and the pallet 500 is placed on the auxiliary leg unit 160.

Figure 9A:
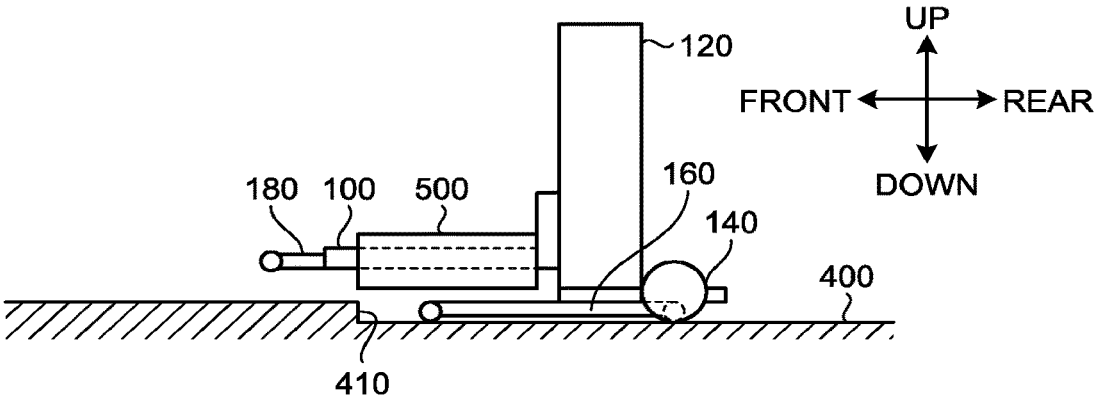
FIG. 9A is a schematic diagram illustrating a stepped portion get-over operation when a stepped portion is an ascending stepped portion.
Figure 9B:
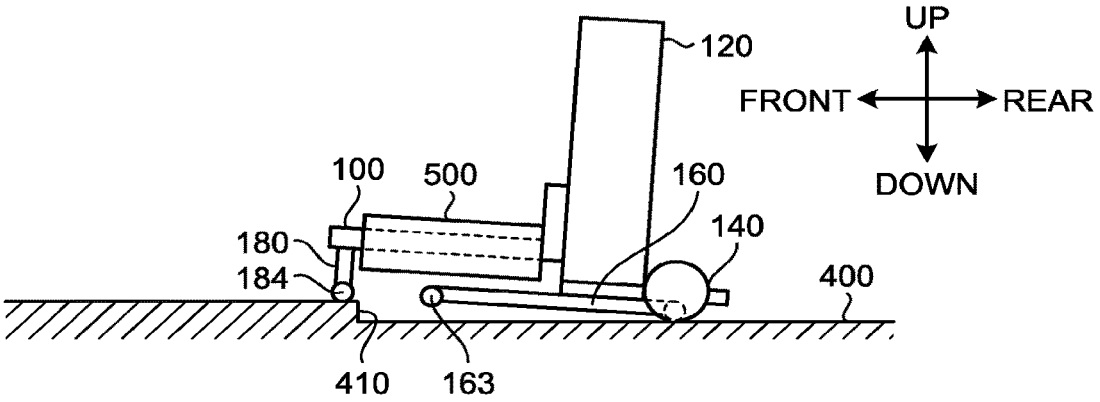
FIG. 9B is a schematic diagram illustrating the stepped portion get-over operation when the stepped portion is the ascending stepped portion.
Figure 9C:
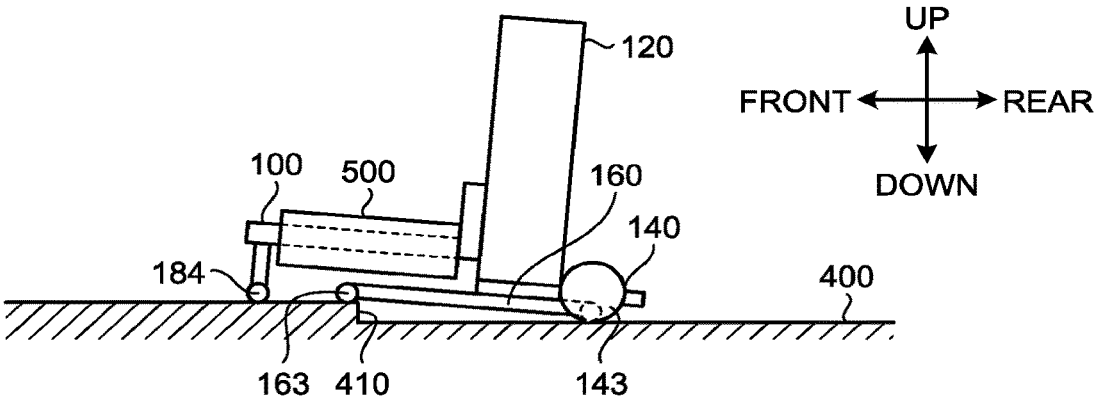
FIG. 9C is a schematic diagram illustrating the stepped portion get-over operation when the stepped portion is the ascending stepped portion.
Figure 10:
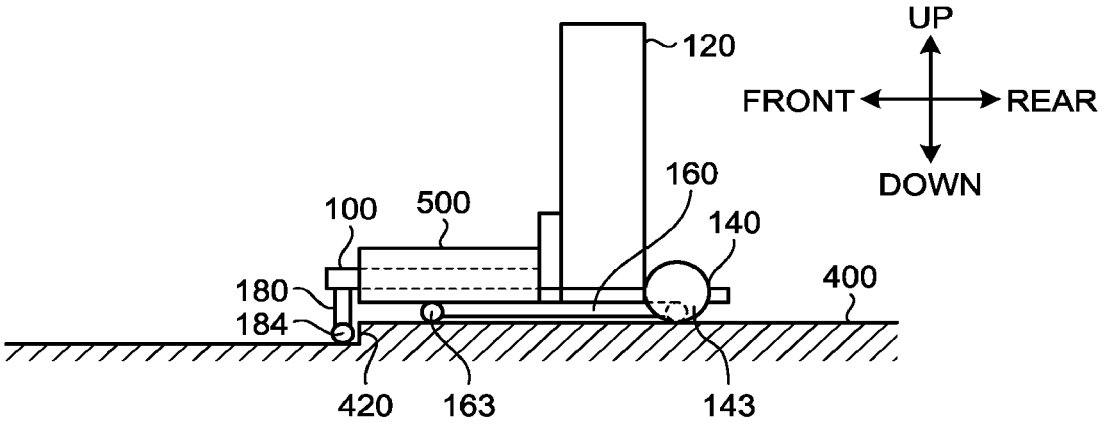
FIG. 10 is a schematic diagram illustrating a stepped portion get-over operation when a stepped portion is a descending stepped portion.
Figure 11:
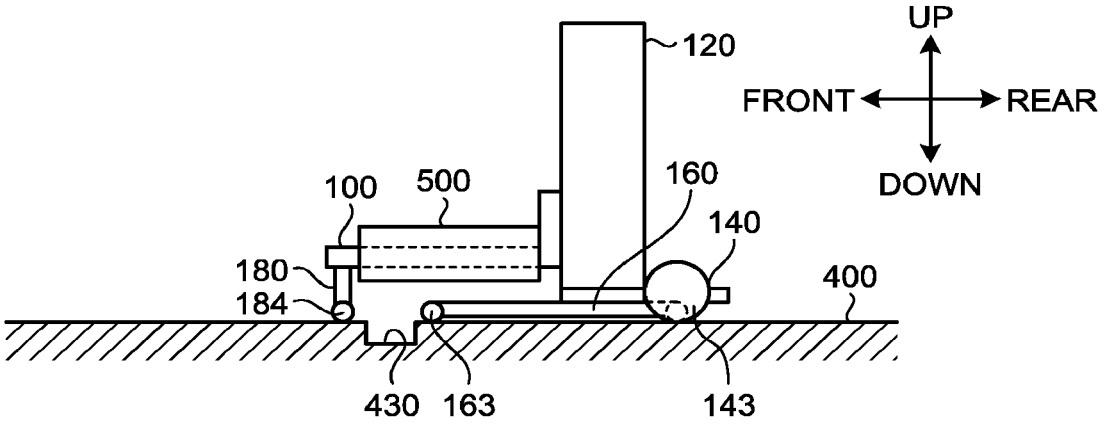
FIG. 11 is a schematic diagram illustrating a stepped portion get-over operation when a stepped portion is a groove.

Next, a stepped portion get-over operation by the conveyance apparatus according to the embodiment is described with reference to FIGS. 9A to 9C, FIG. 10 and FIG. 11. FIGS. 9A to 9C are schematic diagrams illustrating the stepped portion get-over operation when a stepped portion is an ascending stepped portion. FIG. 10 is a schematic diagram illustrating the stepped portion get-over operation when the stepped portion is a descending stepped portion, and FIG. 11 is a schematic diagram illustrating the stepped portion get-over operation when the stepped portion is a groove.

In this embodiment, with respect to the conveyance apparatus, it is assumed that the pallet 500 is lifted by the fork unit 100 and, thereafter, the conveyance apparatus travels on the traveling surface 400 in a state where the wheels 184 of the distal end support mechanisms 180 are not brought into contact with the traveling surface 400. When an ascending stepped portion 410 of the traveling surface 400 is detected during traveling of the conveyance apparatus, the conveyance apparatus temporarily stops immediately in front of the ascending stepped portion 410 (see FIG. 9A). Then, the distal end support mechanism 180 is driven so as to bring the wheels 184 of the distal end support mechanisms 180 into contact with the traveling surface 400 in front of the ascending stepped portion 410. As a result, the auxiliary wheels 163 disposed on the front sides of the auxiliary leg units 160 can be lifted from the traveling surface 400 in front of the ascending stepped portion 410 (see FIG. 9B).

Thereafter, by making the conveyance apparatus move forward with the auxiliary wheels 163 disposed on the front sides of the auxiliary leg units 160 in a lifted state, it is possible to bring the auxiliary wheels 163 disposed on the front sides of the auxiliary leg units 160 into contact with the traveling surface 400 on the front side of the ascending stepped portion 410 (see FIG. 9C). As a result, the weight of the conveyance apparatus, which is biased toward the front side due to the weight of the pallet 500, is applied to the traveling surface 400 in front of the ascending stepped portion 410. Accordingly, the load applied to the drive wheels 143 of the movable cart unit 140 which are in contact with the traveling surface 400 in front of the ascending stepped portion 410 is reduced. When the conveyance apparatus further moves forward in such a state, the conveyance apparatus can easily get over the ascending stepped portion 410 by the drive wheels 143 having a large wheel diameter.

In addition, when a descending stepped portion 420 of the traveling surface 400 is detected during traveling, the conveyance apparatus temporarily stops immediately in front of the descending stepped portion 420, and the distal end support mechanism 180 is driven so as to bring the wheels 184 of the distal end support mechanisms 180 into contact with the traveling surface 400 in front of the descending stepped portion 420 (see FIG. 10). Thereafter, the conveyance apparatus moves forward in a state where the wheels 184 of the distal end support mechanisms 180 are brought into contact with the traveling surface 400 in front of the descending stepped portion 420. Accordingly, the conveyance apparatus can get over the descending stepped portion 420 by the drive wheels 143 having a large wheel diameter without receiving a large impact in a state where the auxiliary wheels 163 disposed on the front sides of the auxiliary leg units 160 float from the traveling surface 400.

Further, when a groove 430 of the traveling surface 400 is detected during traveling, the conveyance apparatus temporarily stops immediately in front of the groove 430, and the distal end support mechanism 180 is driven so as to bring the wheels 184 of the distal end support mechanisms 180 into contact with the traveling surface 400 in front of the groove 430 (see FIG. 11). Thereafter, the conveyance apparatus moves forward in a state where the wheels 184 of the distal end support mechanisms 180 are in contact with the traveling surface 400 disposed in front of the groove 430. Accordingly, the conveyance apparatus can get over the groove 430 by the drive wheels 143 having a large wheel diameter without receiving a large impact in a state where the auxiliary wheels 163 on the front sides of the auxiliary leg units 160 float from the traveling surface 400.

Next, with reference to FIGS. 12A to 12F, a platform riding operation performed by the conveyance apparatus of the embodiment is described. FIGS. 12A to 12F are schematic diagrams illustrating the platform riding operation. The platform riding operation is an operation of getting on a platform of a truck or getting over a large ascending stepped portion.

In this embodiment, a case where the conveyance apparatus moves onto a platform 450 of a truck will be described as an example. When the conveyance apparatus approaches the platform 450 of the truck, the lift unit 120 raises a fork unit 110, and lifts the pallet 500 supported by the fork unit 110 to a height higher than the platform 450. Then, the conveyance apparatus stops immediately in front of the platform 450 (see FIG. 12A).

Figure 12A:
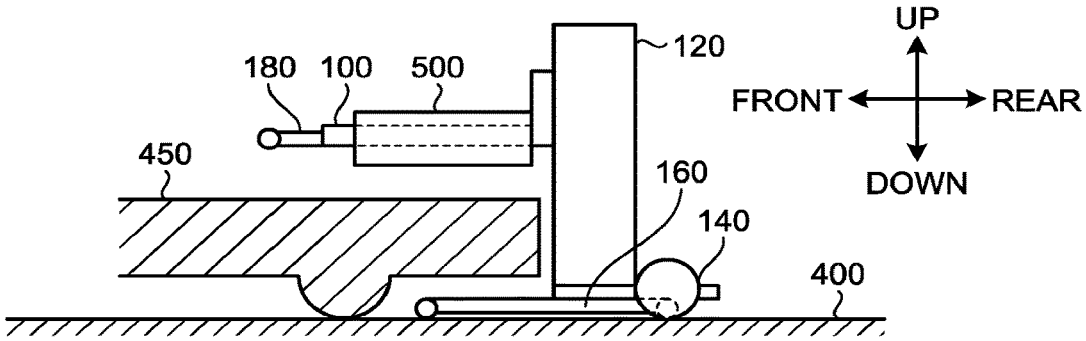
FIG. 12A is a schematic diagram illustrating a platform riding operation.
Figure 12B:
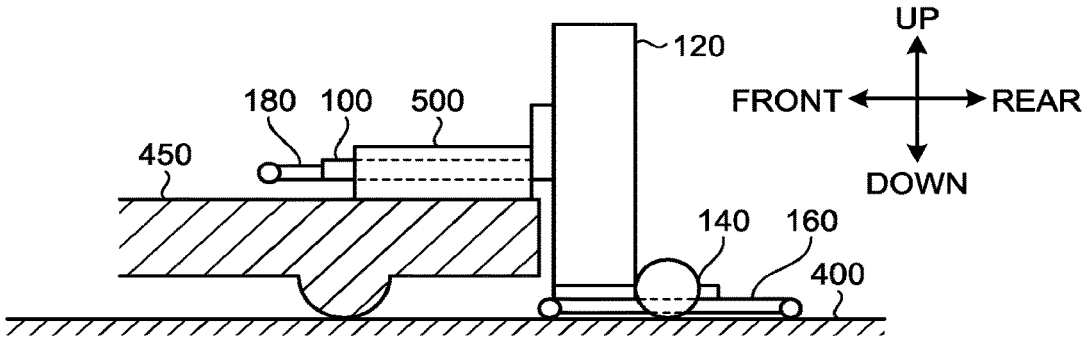
FIG. 12B is a schematic diagram illustrating the platform riding operation.

Thereafter, the lift unit 120 lowers the fork unit 110, places the pallet 500 supported by the fork unit 110 on the platform 450, and moves the auxiliary leg units 160 rearward (see FIG. 12B). As a result, most of the weight of the conveyance apparatus biased toward a front side by the weight of the pallet 500 is supported on the platform 450.

When the lift unit 120 is driven so as to lower the fork unit 100 in this state, the pallet 500 supported by the fork unit 100 is in contact with the platform 450 and hence, the fork unit 100 cannot be lowered. Accordingly, the movable cart unit 140 which supports the lift unit 120 and the auxiliary leg unit 160 connected to the movable cart unit 140 are apart from the traveling surface 400 and move upward (i.e., float) (see FIG. 12C).

When the auxiliary leg units 160 are lifted to the height of the platform 450, the auxiliary leg units 160 are moved forward, the front auxiliary wheels 163 are brought into contact with the platform 450, and the rotation of the auxiliary wheels 163 on the front side is prevented by the brake mechanisms, thereby preventing the movement of the auxiliary wheels 163 on the front side on the platform 450. Further, the distal end support mechanisms 180 are driven so as to bring the wheels 184 into contact with the platform 450, and the fork unit 100 is lifted by the lift unit 120 to float the pallet 500 supported by the fork unit 100 from the platform 450 (see FIG. 12D).

When the auxiliary leg unit 160 is driven so as to move rearward in this state, since the rotation of the auxiliary wheels 163 on the front side is prevented by the brake mechanisms, the auxiliary leg units 160 are not movable on the platform 450. Accordingly, the movable cart unit 140 moves forward, and the drive wheels 143 are brought into contact with the platform 450 (see FIG. 12E).

Figure 12C:
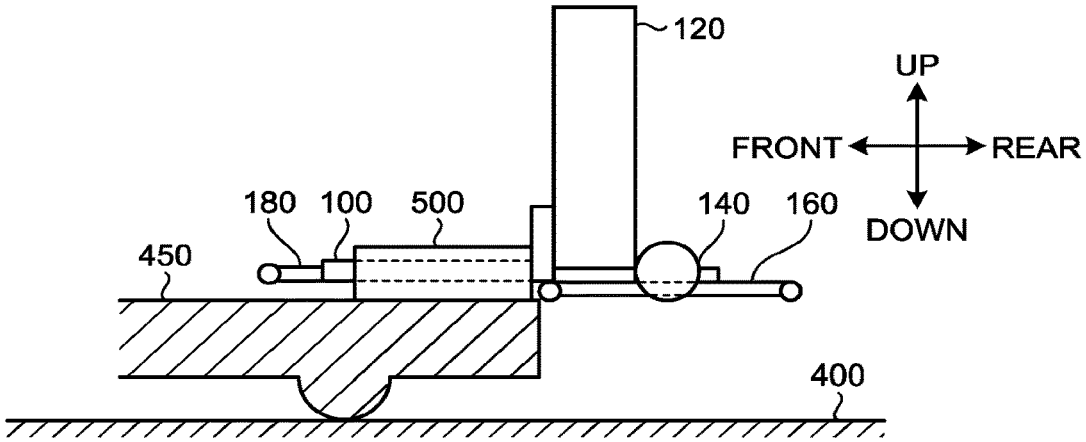
FIG. 12C is a schematic diagram illustrating the platform riding operation.
Figure 12D:
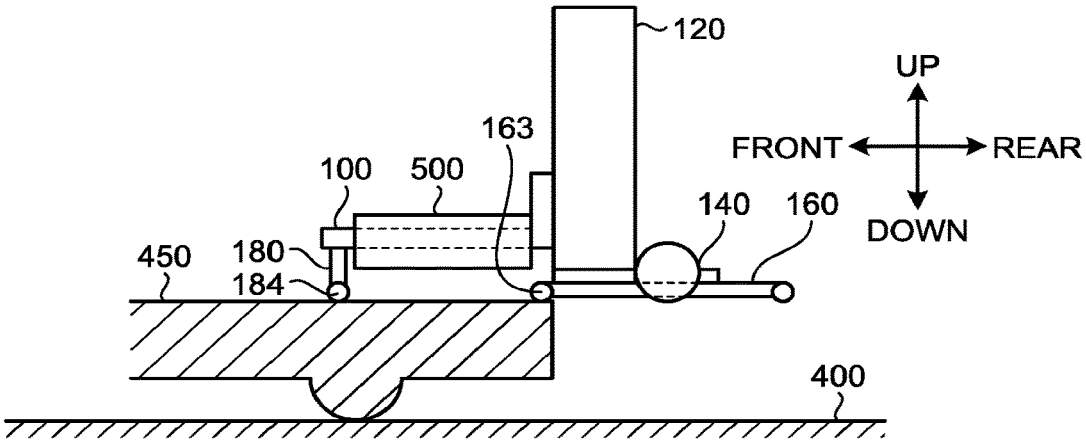
FIG. 12D is a schematic diagram illustrating the platform riding operation.
Figure 12E:
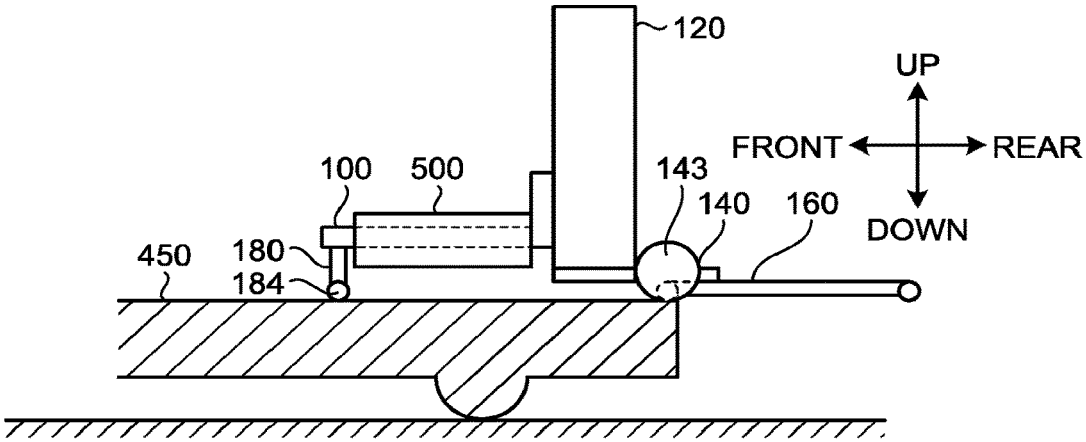
FIG. 12E is a schematic diagram illustrating the platform riding operation.
Figure 12F:
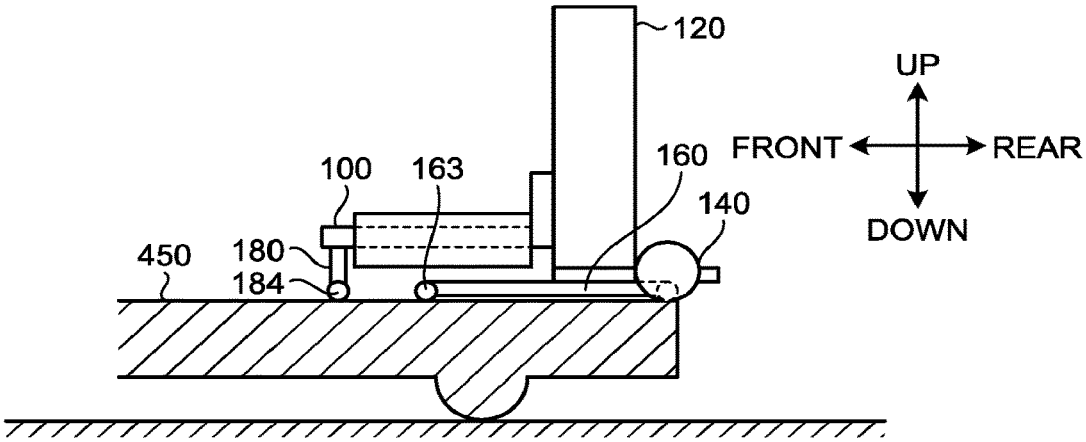
FIG. 12F is a schematic diagram illustrating the platform riding operation.

Thereafter, the brake mechanism is released, and the auxiliary leg units 160 are moved forward (see FIG. 12F). As a result, the auxiliary wheels 163 on the front sides of the auxiliary leg units 160 become in the contact state with the platform 450 below the pallet 500 supported by the fork unit 100. Accordingly, the conveyance apparatus can move stably on the platform 450.

Figure 13A:
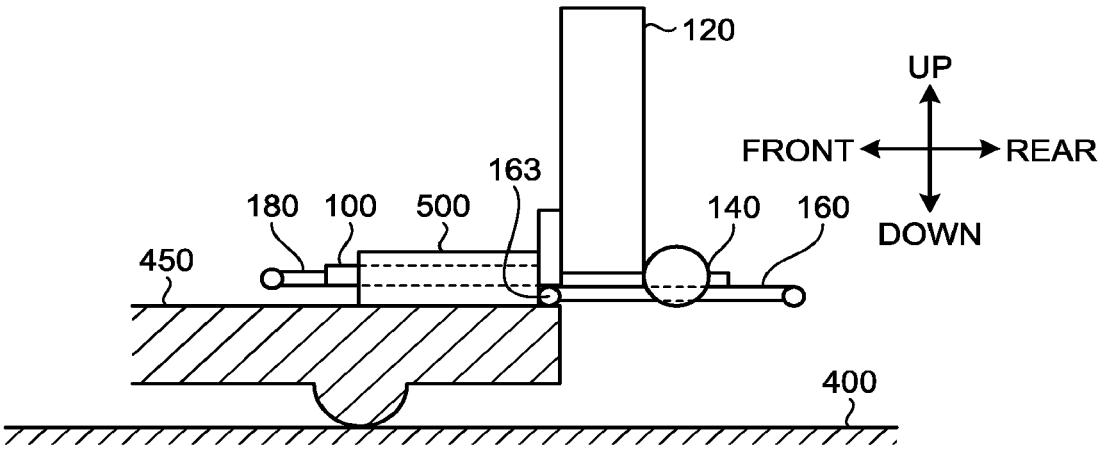
FIG. 13A is a schematic diagram illustrating a modification of the platform riding operation.
Figure 13B:
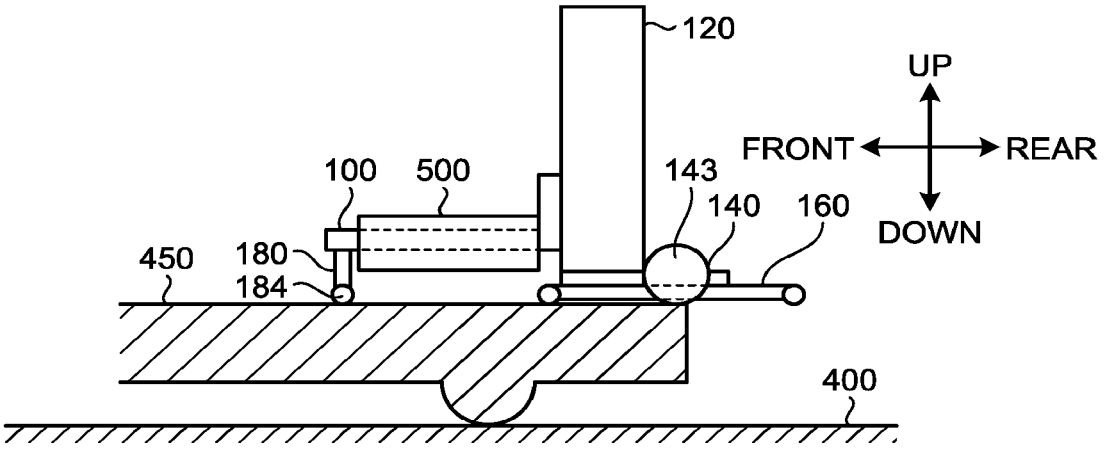
FIG. 13B is a schematic diagram illustrating the modification of the platform riding operation.

In a case where the configuration is adopted where the wheels 184 of the distal end support mechanisms 180 have a driving force, in place of the operation illustrated in FIGS. 12D and 12E, an operation illustrated in FIGS. 13A and 13B may be adopted where the drive wheels 143 of the movable cart unit 140 are brought into contact with the platform 450.

That is, after the auxiliary leg units 160 are moved forward from the state illustrated in FIG. 12C and the auxiliary wheels 163 on the front sides are brought into contact with the platform 450 (see FIG. 13A), the distal end support mechanisms 180 are driven so as to bring the wheels 184 into contact with the platform 450. In addition, the fork unit 100 is lifted by the lift unit 120, and the pallet 500 supported by the fork unit 100 is lifted from the platform 450. At this stage of the operation, by pulling the movable cart unit 140 forward by driving the wheels 184 of the distal end support mechanisms 180, the drive wheels 143 of the movable cart unit 140 can be brought into contact with the platform 450 (see FIG. 13B).

In the case where the conveyance apparatus gets on the platform 450 of the truck, as illustrated in FIG. 12A, the conveyance apparatus can approach the platform 450 in a state where the auxiliary leg units 160 project forward. However, in a case where the conveyance device moves onto a large ascending stepped portion, when the conveyance apparatus approaches the ascending stepped portion in a state where the auxiliary leg units 160 project forward, the auxiliary leg units 160 interfere with the ascending stepped portion. Therefore, in the case where the conveyance apparatus moves onto a large ascending stepped portion, the conveyance apparatus can approach the large ascending stepped portion by moving the movable cart unit 140 forward while moving the auxiliary leg units 160 rearward, and the pallet 500 which is supported by the fork unit 110 is placed on the platform 450 by lowering the fork unit 110 by the lift unit 120. As a result, a state substantially equal to the state illustrated in FIG. 12B is realized and, thereafter, the conveyance apparatus can moves onto a large stepped portion in accordance with the above-described steps.

Figure 14:
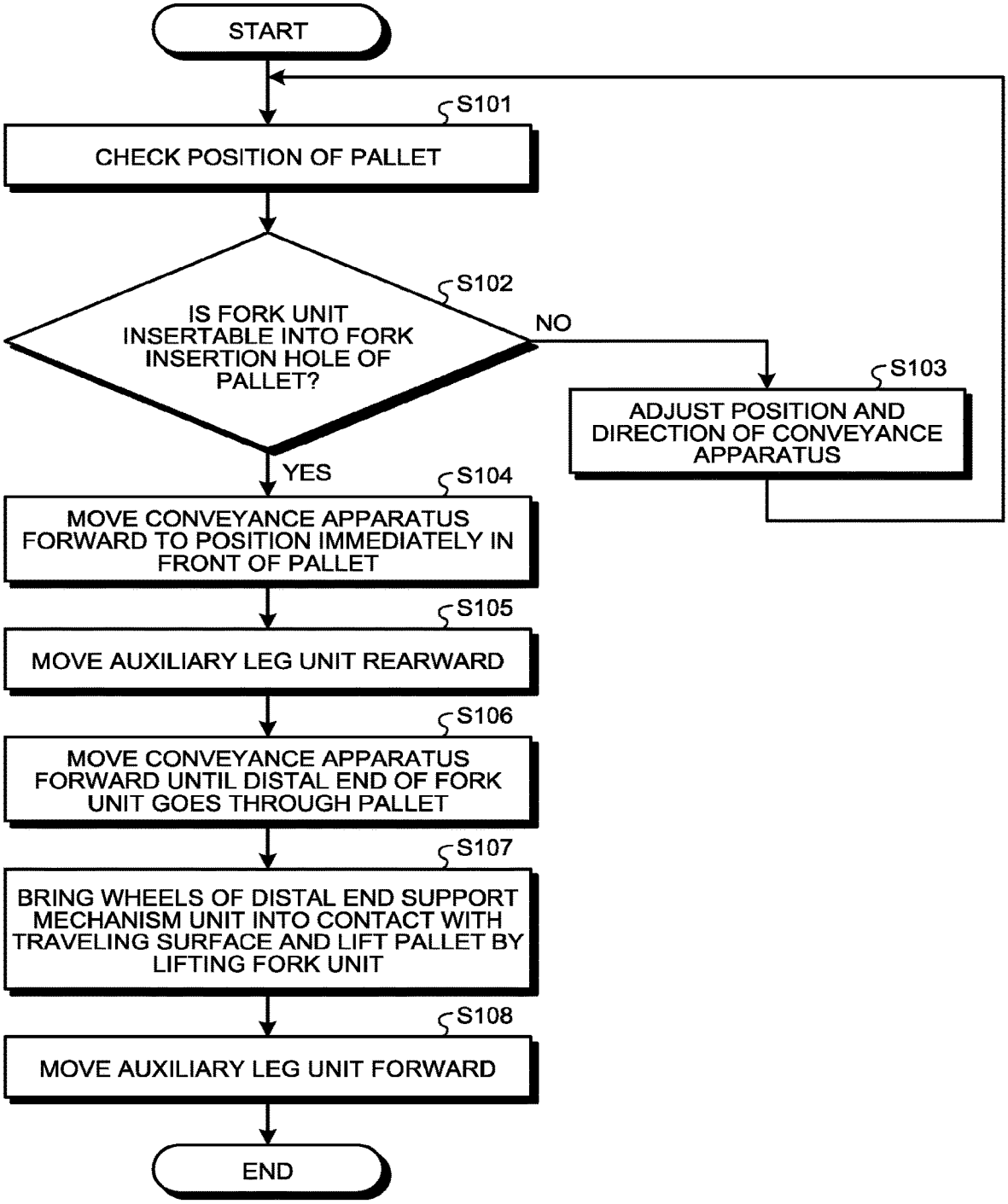
FIG. 14 is a flowchart illustrating a flow of processing by a movement control unit and a lifting control unit.

Next, a specific example of processing executed by the control functions of the control processor 310 will be described. First, processing by the movement control unit 311 and the lifting control unit 312 in the pallet lifting operation described above will be described with reference to FIG. 14. FIG. 14 is a flowchart illustrating a flow of processing by the movement control unit 311 and the lifting control unit 312 in the pallet lifting operation.

First, the movement control unit 311 checks the position of the pallet 500 based on the anterior information acquired by the acquisition unit 306 (an image picked up by the camera 205 and the distance information measured by the distance sensor 206) (step S101). Then, the movement control unit 311 determines whether or not the fork unit 110 can be inserted into the fork insertion hole of the pallet 500 by directly making the conveyance apparatus move forward from the current position (step S102). When the movement control unit 311 determines that the fork unit 110 cannot be inserted into the fork insertion hole of the pallet 500 (step S102: No), the movement control unit 311 adjusts the position and the direction of the conveyance apparatus by moving the movable cart unit 140 to an appropriate position (step S103), and the movement control unit 311 repeats the processing in steps S101 and S102.

On the other hand, when the movement control unit 311 determines that the fork unit 110 can be inserted into the fork insertion hole of the pallet 500 by moving the conveyance apparatus forward from the current position directly (step S102: Yes), the movement control unit 311 makes the conveyance apparatus move forward to a position immediately in front of the pallet 500 and stops the conveyance apparatus at the position immediately in front of the pallet 500 by controlling the operation of the movable cart unit 140 while monitoring the anterior information acquired by the acquisition unit 306 (step S104).

When the conveyance apparatus stops immediately in front of the pallet 500, as a next step, the lifting control unit 312 moves the auxiliary leg units 160 rearward (step S105). At this stage of the operation, if the height of the fork unit 100 is displaced from the position of the fork insertion hole of the pallet 500, the lifting control unit 312 adjusts the height position of the fork unit 100 by controlling the operation of the lift unit 120. Then, the movement control unit 311 controls the operation of the movable cart unit 140 while monitoring the anterior information acquired by the acquisition unit 306, and makes the conveyance apparatus move forward until the distal end of the fork unit 100 penetrates the pallet 500 (step S106).

Next, the lifting control unit 312 brings the wheels 184 of the distal end support mechanisms 180 into contact with the traveling surface 400 and lifts the pallet 500 by lifting the fork unit 100 by controlling the operation of the distal end support mechanisms 180 and the operation of the lift unit 120 (step S107). Thereafter, the lifting control unit 312 brings the auxiliary wheels 163 disposed on the front sides of the auxiliary leg units 160 into the contact state with the traveling surface 400 below the pallet 500 by moving the auxiliary leg units 160 forward (step S108). With such processing, the pallet lifting operation is completed.

Figure 15:
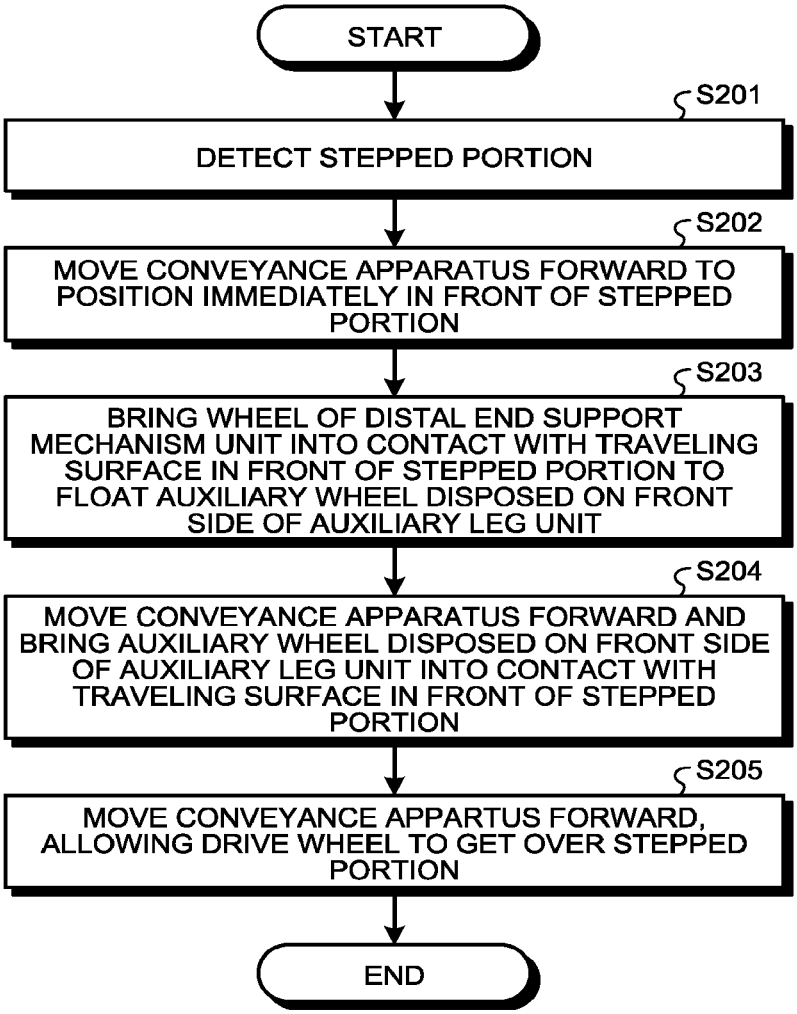
FIG. 15 is a flowchart illustrating a flow of processing by a stepped portion detection unit and a stepped portion get-over control unit.

Next, with reference to FIG. 15, processing performed by the stepped portion detection unit 313 and the stepped portion get-over control unit 314 in the above stepped portion get-over operation will be described. FIG. 15 is a flowchart illustrating the flow of processing by the stepped portion detection unit 313 and stepped portion get-over control unit 314 in the stepped portion get-over operation.

The stepped portion detection unit 313 detects a stepped portion of the traveling surface 400 based on the anterior information acquired by the acquisition unit 306 (an image picked up by the camera 205 and the distance information measured by the distance sensor 206) during traveling of the conveyance apparatus (step S201). The stepped portion detected in this processing is assumed to be any one of the ascending stepped portion 410, the descending stepped portion 420 or the groove 430 described above.

When a stepped portion on the traveling surface 400 is detected by the stepped portion detection unit 313, the stepped portion get-over control unit 314 controls the operation of the movable cart unit 140 and makes the conveyance apparatus move forward to the position immediately in front of the stepped portion detected by the stepped portion detection unit 313. Then, the stepped portion detection unit 313 stops the conveyance apparatus immediately before the stepped portion (step S202). Then, the stepped portion get-over control unit 314 brings the wheel(s) 184 of the distal end support mechanisms 180 into contact with the traveling surface 400 in front of the stepped portion and brings the auxiliary wheel(s) 163 disposed on the front sides of the auxiliary leg units 160 in a state where the auxiliary wheel(s) 163 floats/float from the traveling surface 400 in front of the stepped portion by controlling the operation of the distal end support mechanisms 180 (step S203).

Next, the stepped portion get-over control unit 314 makes the conveyance apparatus move forward and brings the auxiliary wheel 163 disposed on the front side of the auxiliary leg unit 160 into contact with the traveling surface 400 in front of the stepped portion by controlling the operation of the movable cart unit 140 (Step S204). Thereafter, the stepped portion get-over control unit 314 further makes the conveyance apparatus move forward so that the drive wheels 143 of the movable cart unit 140 get over the stepped portion by controlling the operation of the movable cart unit 140 (step S205). With such processing, the stepped portion get-over operation is completed.

Figure 16:
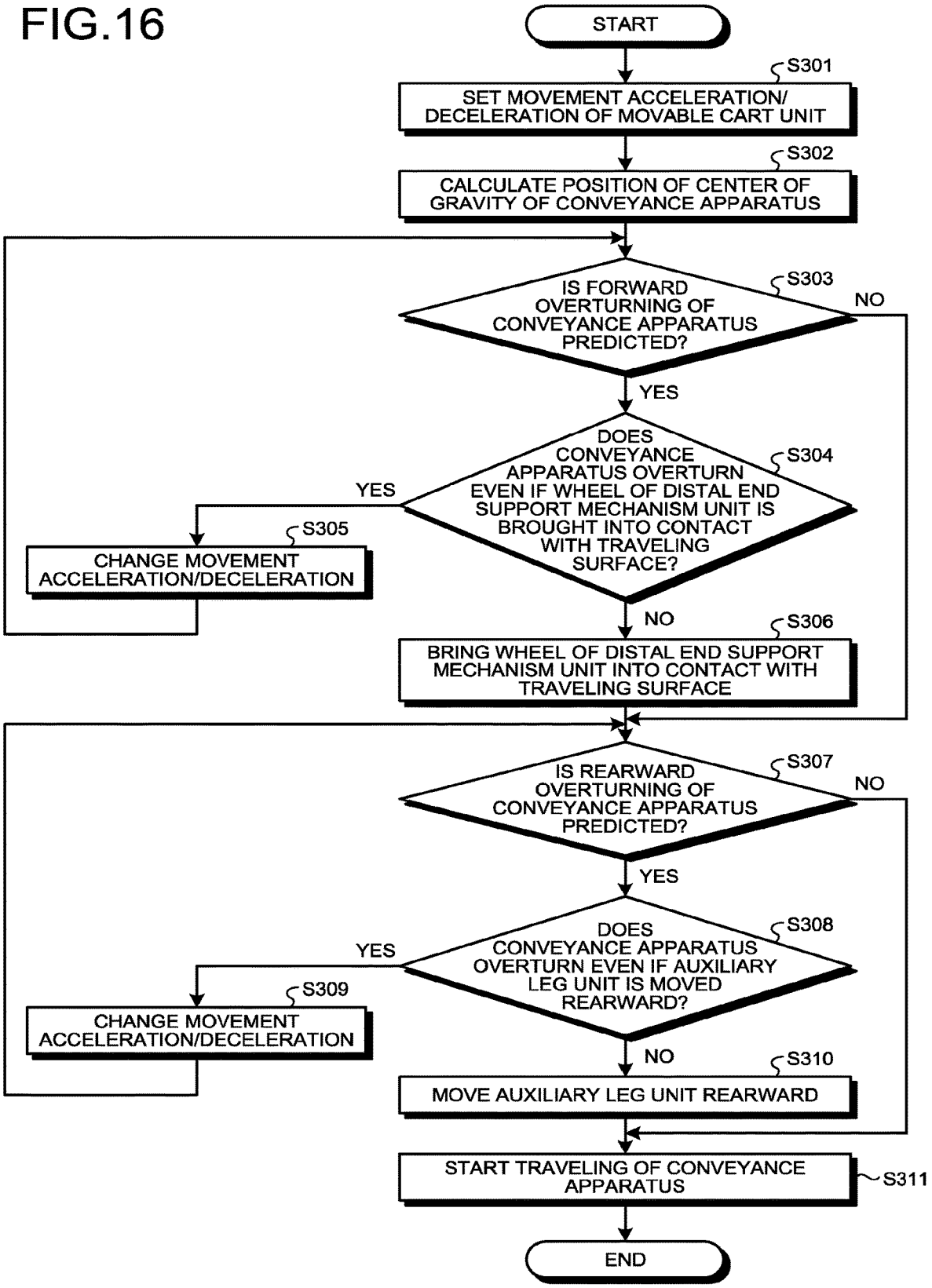
FIG. 16 is a flowchart illustrating the flow of processing by a gravity center position calculation unit and an overturning prevention control unit.

Next, with reference to FIG. 16, processing performed by the gravity center position calculation unit 315 and the overturning prevention control unit 316 in the overturning prevention operation will be described. FIG. 16 is a flowchart illustrating a flow of processing by the gravity center position calculation unit 315 and the overturning prevention control unit 316 in the overturning prevention operation. The overturning prevention operation is an operation to prevent the conveyance apparatus which conveys a load (the pallet 500 and a stacked product stacked on the pallet 500) from overturning forward or rearward due to a moment of inertia which acts on the conveyance apparatus when traveling of the conveyance apparatus is started or stopped. The overturning prevention operation is performed before the conveyance apparatus starts traveling.

First, the overturning prevention control unit 316 sets the movement acceleration/deceleration of the movable cart unit 140 (step S301). Next, the gravity center position calculation unit 315 calculates the position of the center of gravity X of the conveyance apparatus which conveys a load, based on the weight of the load detected by the load weight detection unit 305 (the pressure sensor 203 or the load sensor 204) (step S302). Details of a specific example of a method for calculating the position of the center of gravity X will be described later.

Next, the overturning prevention control unit 316 determines whether or not forward overturning of the conveyance apparatus is predicted based on the position of the center of gravity X calculated in step S302 and the movement acceleration/deceleration set in step S301. (Step S303). Then, when the overturning prevention control unit 316 determines that forward overturning is predicted (step S303: Yes), the overturning prevention control unit 316 determines whether or not the conveyance apparatus overturns even if the wheels 184 of the distal end support mechanisms 180 are brought into contact with the traveling surface 400 (step S304). A specific example of the method for determining overturning is mentioned later in details.

At this stage of the operation, when the overturning prevention control unit 316 determines that the conveyance apparatus overturns even if the wheels 184 of the distal end support mechanisms 180 are brought into contact with the traveling surface 400 (step S304: Yes), the overturning prevention control unit 316 changes the movement acceleration/deceleration set in step S301 to a low value (Step S305), and the processing returns to step S303 and the determination is repeated. On the other hand, when the overturning prevention control unit 316 determines that the conveyance apparatus does not overturn if the wheels 184 of the distal end support mechanisms 180 are brought into contact with the traveling surface 400 (step S304: No), the overturning prevention control unit 316 brings the wheels 184 into contact with the traveling surface 400 by controlling the operation of the distal end support mechanisms 180 (step S306). Then, the processing advances to the next step S307. When the overturning prevention control unit 316 determines in step S303 that forward overturning is not predicted (step S303: No), the processing directly advances to step S307.

Next, the overturning prevention control unit 316 determines whether or not rearward overturning of the conveyance apparatus is predicted based on the position of the center of gravity X calculated in step S302, and the movement acceleration/deceleration set in step S301 or the movement acceleration/deceleration changed in step S305 (step S307). Then, when the overturning prevention control unit 316 determines that rearward overturning is predicted (step S307: Yes), the overturning prevention control unit 316 determines whether or not the conveyance apparatus overturns even if the auxiliary leg units 160 are moved rearward (step S308).

At this stage of the operation, when the overturning prevention control unit 316 determines that the conveyance apparatus overturns even if the auxiliary leg units 160 are moved rearward (step S308: Yes), the overturning prevention control unit 316 changes the movement acceleration/deceleration to a low value (step S309), and the processing returns to step S307 and the overturning prevention control unit 316 repeats the determination. On the other hand, when the overturning prevention control unit 316 determines that the conveyance apparatus does not overturn if the auxiliary leg units 160 are moved rearward (step S308: No), the overturning prevention control unit 316 makes the auxiliary leg units 160 move rearward (step S310). Then, traveling of the conveyance apparatus is started (step S311), and the movement control unit 311 controls an operation of the movable cart unit 140 such that the movement acceleration/deceleration detected by the acceleration sensor 201 does not exceed the movement acceleration/deceleration set in step S301 or the movement acceleration/deceleration changed in step S305. When the overturning prevention control unit 316 determines in step S307 that rearward overturning is not predicted (step S307: No), the processing directly advances to step S311 and traveling of the conveyance apparatus is started.

Next, a specific example of a method for calculating the position of the center of gravity X by the gravity center position calculation unit 315 will be described with reference to the schematic diagram illustrated in FIG. 17. In this embodiment, the description is made assuming that the conveyance apparatus is stopped on an uphill slope. In this case, a weight W of a load detected by the load weight detection unit 305 is a component in a slope normal line direction of an actual weight W2 of the load. The inclination of the conveyance apparatus detected by the inclination sensor 202 represents an inclination angle θ of the slope.

The actual load weight W2 is obtained from an equation $W2=W/\cos\theta$ based on the slope normal direction component W of the load weight detected by the load weight detection unit 305 and the inclination angle θ detected by the inclination sensor 202. Note that an equation $W2=W$ is established when the conveyance apparatus is stopped on a horizontal traveling surface 400.

In this case, it is assumed that the position of the center of gravity X2 of the load is near the center of the load. A weight W1 and the position of the center of gravity X1 of the conveyance apparatus itself are known values. The position of the center of gravity X of the conveyance apparatus which conveys the load can be calculated using the weight W1 and the position of the center of gravity X1 of the conveyance apparatus itself, and the weight W2 and the position of the center of gravity X2 of the load.

Figure 17:
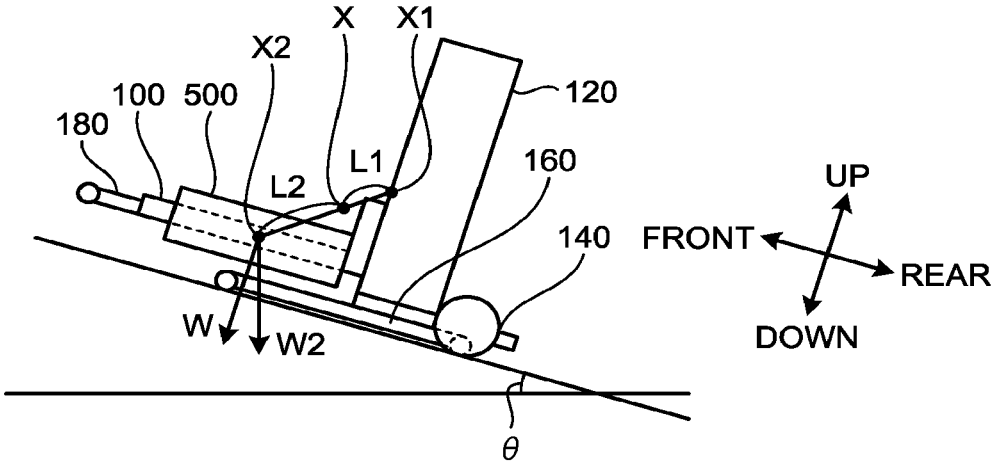
FIG. 17 is a schematic diagram for explaining a specific example of a method for calculating a position of the center of gravity.

That is, as illustrated in FIG. 17, the position of the center of gravity X of the conveyance apparatus which conveys the load exists on a straight line which connects the position of the center of gravity X1 of the conveyance apparatus itself and the position of the center of gravity X2 of the load at a position corresponding to a ratio between the weight W2 of the load and the weight W1 of the conveyance apparatus itself. Assuming a distance between X1 and X as L1, and a distance between X and X2 as L2, a relationship of L1:L2=W2:W1 is established.

Figure 18:
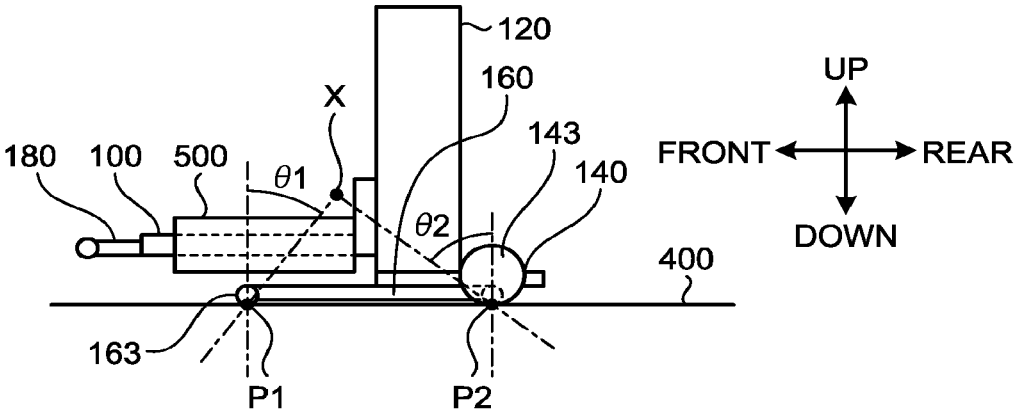
FIG. 18 is a schematic diagram for explaining a specific example of a method for determining whether or not the conveyance apparatus overturns.

Next, a specific example of a method for determining whether or not the conveyance apparatus overturns is described with reference to the schematic diagrams illustrated in FIGS. 18 and 19. First, the case is considered where, as illustrated in FIG. 18, the wheels 184 of the distal end support mechanisms 180 are not brought into contact with the traveling surface 400, and the auxiliary wheels 163 disposed on the front sides of the auxiliary leg units 160 support a load on the front side of the conveyance apparatus. In this case, a frontmost ground contact point P1 of the conveyance apparatus is a position where the auxiliary wheels 163 disposed on the front sides of the auxiliary leg units 160 are brought into contact with the traveling surface 400, and a rearmost ground contact point P2 of the conveyance apparatus is a position where the drive wheels 143 of the movable cart unit 140 (or the auxiliary wheel 163 on the rear side of the auxiliary leg unit 160) are brought into contact with the traveling surface 400.

Assuming an angle formed between a line which connects the frontmost ground contact point P1 and the position of the center of gravity X of the conveyance apparatus and a vertical direction as $\theta 1$, an angle formed between a line which connects the rearmost ground contact point P2 and the position of the center of gravity X of the conveyance apparatus and the vertical direction as $\theta 2$, the acceleration when the conveyance apparatus is moving forward (deceleration of the conveyance apparatus which is moving backward) as $\alpha 1$, and the acceleration when the conveyance apparatus is moving back (the deceleration of the conveyance apparatus which is moving forward) as $\alpha 2$, due to a geometric relationship, the conditions under that the conveyance apparatus does not overturn are $\alpha 1 < g \cdot \tan \theta 2$ and $\alpha 2 < g \cdot \tan \theta 1$. Therefore, it is possible to determine whether or not the conveyance apparatus overturns based on whether or not these conditions are satisfied with respect to the set or changed movement acceleration/deceleration $\alpha 1$, $\alpha 2$.

Figure 19:
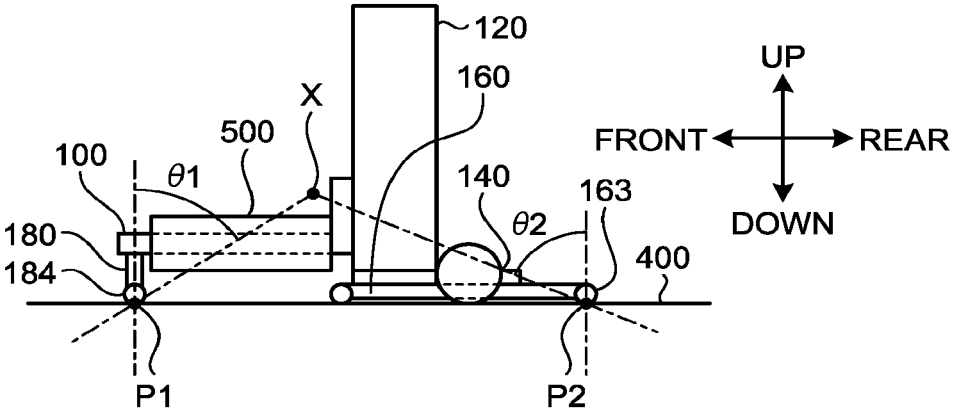
FIG. 19 is a schematic diagram for explaining a specific example of a method for determining whether or not the conveyance apparatus overturns.

When the wheels 184 of the distal end support mechanisms 180 are brought into contact with the traveling surface 400, as illustrated in FIG. 19, the position where the wheels 184 of the distal end support mechanisms 180 are brought into contact with the traveling surface 400 becomes the frontmost ground contact point P1 of the conveyance apparatus. In this case, the above-described angle $\theta 1$ becomes larger than the corresponding angle in the example of FIG. 18 and hence, the conveyance apparatus minimally overturns frontward. Further, when the auxiliary leg units 160 are moved rearward, as illustrated in FIG. 19, the position where the auxiliary wheels 163 on the rear side of the auxiliary leg units 160 are in contact with the traveling surface 400 is the rearmost contact point of P2 of the conveyance apparatus. In this case, the above-mentioned angle $\theta 2$ becomes larger than the angle $\theta 2$ in the example of FIG. 18 and hence, the conveyance apparatus will minimally overturn rearward. Also in these cases, it is possible to determine whether or not the conveyance apparatus overturns based on whether or not the set or changed moving acceleration/deceleration $\alpha 1$, $\alpha 2$ satisfy the above-described conditions.

As has been described in detail heretofore by exemplifying specific examples, the conveyance apparatus according to the embodiment includes: the fork unit 100; the lift unit 120 which drives the fork unit 100 upward and downward; the movable cart unit 140 which supports the lift unit 120 and is movable on the traveling surface 400 by driving the drive wheel 143; the auxiliary leg units 160 which are connected to the movable cart unit 140 in a state where the auxiliary leg units 160 are movable along the longitudinal direction of the fork unit 100, the position of the auxiliary wheels 163 which are brought into contact with the traveling surface 400 being changeable relative to the movable cart unit 140; and the distal end support mechanisms 180 which are provided on the distal end sides of the fork unit 100, and are capable of switching a state of the distal end support mechanisms 180 between a state where the distal end support mechanisms 180 are not brought into contact with the traveling surface 400 and a state where the distal end support mechanisms 180 are brought into contact with the traveling surface 400. With such a configuration, the conveyance apparatus of the embodiment can perform various operations necessary for conveying a load with a compact configuration in an unmanned state.

In the conveyance apparatus of the embodiment, the lift unit 120 lifts the fork unit 100 in a linked manner with the switching of a state of the distal end support mechanisms 180 from the state where the distal end support mechanisms 180 are not brought into contact with the traveling surface 400 to the state where the distal end support mechanisms 180 are brought into contact with the traveling surface 400. Accordingly, it is possible to bring the distal end support mechanisms 180 into contact with the traveling surface 400 while maintaining a load such as the pallet 500 supported by the fork unit 100 in a horizontal state.

Further, in the conveyance apparatus of the embodiment, the wheels 184 are provided at the position of the distal end support mechanisms 180 where the wheels 184 are brought into contact with the traveling surface 400. With such a configuration, the conveyance apparatus can travel on the traveling surface 400 in a state where the distal end support mechanisms 180 are brought into contact with the traveling surface 400.

In the conveyance apparatus of the embodiment, the auxiliary leg units 160 are configured such that, in a state where a load such as the pallet 500 is lifted by the fork unit 100 and the distal end support mechanisms 180 are brought into contact with the traveling surface 400, the position at which the auxiliary wheels 163 are brought into contact with the traveling surface 400 is changed from a position that is apart from a underside of the load to the position in the underside of the load. With such a configuration, the weight of the conveyance apparatus biased toward a front side by the weight of the load can be received by the auxiliary wheels 163 of the auxiliary leg units 160. Accordingly, the stability of the conveyance apparatus when the conveyance apparatus travels can be improved.

Further, in the conveyance apparatus of the embodiment, in a case where the traveling surface 400 has a stepped portion, the distal end support mechanisms 180 are brought into contact with the traveling surface 400 so as to lift the auxiliary wheels 163 of the auxiliary leg units 160 from the traveling surface 400. With such a configuration, the auxiliary wheels 163 of the auxiliary leg units 160 can get over the stepped portion without interfering with the stepped portion of the traveling surface 400.

Further, in the conveyance apparatus of the embodiment, for example, the movable cart unit 140 is lifted from the traveling surface 400 by allowing the lift unit 120 to drive the fork unit 100 downward in a state where the fork unit 100 or a load such as the pallet 500 supported by the fork unit 100 is in contact with the platform 450. With such a configuration, the conveyance apparatus of the embodiment can get on the platform 450 of the truck or the like. Further, the conveyance apparatus can also get over a large stepped portion or the like by utilizing such an operation.

Further, in the conveyance apparatus of the embodiment, the auxiliary leg unit 160 has a brake mechanism which stops the rotation of the auxiliary wheel 163. This enables an operation of getting on the platform 450 of the truck or the like to be easily performed.

The conveyance apparatus of the embodiment also includes: the acquisition unit 306 which acquires anterior information indicating an anterior state of the fork unit 100; and the movement control unit 311 which controls the movement of the movable cart unit 140 based on the anterior information acquired by the acquisition unit 306. With such a configuration, the conveyance apparatus can appropriately travel on the traveling surface 400.

The conveyance apparatus of the embodiment may also include: the stepped portion detection unit 313 which detects a stepped portion on the traveling surface 400 based on the anterior information acquired by the acquisition unit 306; and the stepped portion get-over control unit 314 which controls an operation of the distal end support mechanism 180 and an operation of the auxiliary leg unit 160 such that the movable cart unit 140 gets over the stepped portion. With such a configuration, even when the traveling surface has a stepped portion, the conveyance apparatus can appropriately get over the stepped portion.

The conveyance apparatus of the embodiment may further include: the load weight detection unit 305 which detects the weight of the load supported by the fork unit 100, the gravity center position calculation unit 315 which calculates a position of the center of gravity of the conveyance apparatus which conveys the load based on the weight of the load detected by the load weight detection unit 305; and the overturning prevention control unit 316 which determines whether or not the conveyance apparatus overturns when the conveyance apparatus conveys the load based on the position of the center of gravity which the gravity center position calculation unit 315 calculates and the set movement acceleration/deceleration, the overturning prevention control unit 316, when the overturning prevention control unit 316 determines that the conveyance apparatus overturns, being configured to bring the distal end support mechanisms 180 in the state where the distal end support mechanisms 180 are not in contact with the traveling surface 400 into contact with the traveling surface 400, move the auxiliary leg units 160 such that the auxiliary wheels 163 are brought into contact with the traveling surface 400 behind the drive wheel 143, or reduce the movement acceleration/deceleration. With such a configuration, the overturning of the conveyance apparatus can be effectively prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A conveyance apparatus comprising:

a fork unit;

a lift unit configured to drive the fork unit upward and downward;

a movable cart unit configured to support the lift unit and be movable on a traveling surface by driving a drive wheel;

an auxiliary leg unit provided for the movable cart unit, the auxiliary leg unit being movable along a longitudinal direction of the fork unit and having an auxiliary wheel a position of which is changeable relative to the movable cart unit;

a distal end support mechanism provided on a distal end side of the fork unit, the distal end support mechanism being switchable between a non-contact state with the traveling surface and a contact state with the traveling surface;

a load weight detection unit configured to detect a weight of a load supported by the fork unit;

a gravity center position calculation unit configured to calculate a position of a center of gravity of the conveyance apparatus that conveys the load based on the weight of the load; and an overturning prevention control unit configured to determine whether or not the conveyance apparatus overturns when the conveyance apparatus conveys the load based on the position of the center of gravity and movement acceleration/deceleration of the movable cart unit that is set, the overturning prevention control unit being configured to, when the overturning prevention control unit determines that the conveyance apparatus overturns, bring the distal end support mechanism in the non-contact state with the traveling surface into contact with the traveling surface, move the auxiliary leg unit such that the auxiliary wheel is brought into contact with the traveling surface behind the drive wheel, or reduce the movement acceleration/deceleration.

2. The conveyance apparatus according to claim 1, further comprising:

a lift drive unit configured to drive the lift unit such that the lift unit lifts the fork unit in a linked manner with switching of a state of the distal end support mechanism from the non-contact state with the traveling surface to the contact state with the traveling surface.

3. The conveyance apparatus according to claim 1, wherein the distal end support mechanism includes a wheel at a position that is brought into contact with the traveling surface.

4. The conveyance apparatus according to claim 1, further comprising:

an auxiliary leg drive unit configured to drive the auxiliary leg unit such that, in a state where a load is lifted by the fork unit and the distal end support mechanism is brought into contact with the traveling surface, a position at which the auxiliary wheel is brought into contact with the traveling surface is changed from a position that is apart from a underside of the load to a position that is the underside of the load.

5. The conveyance apparatus according to claim 1, further comprising:

a distal end support mechanism drive unit configured to drive and move the distal end support mechanism such that, when the traveling surface has a stepped portion, the distal end support mechanism is brought into contact with the traveling surface to float the auxiliary wheel of the auxiliary leg unit from the traveling surface.

6. The conveyance apparatus according to claim 1, further comprising:

a movable cart drive unit configured to drive and move the movable cart unit such that the movable cart unit is made apart from the traveling surface by allowing the lift unit to drive the fork unit downward in a state where the fork unit or a load supported by the fork unit is in contact with a platform.

7. The conveyance apparatus according to claim 1, wherein the auxiliary leg unit includes a brake mechanism that stops a rotation of the auxiliary wheel.

8. The conveyance apparatus according to claim 1, further comprising:

an acquisition unit configured to acquire anterior information indicative of an anterior state of the fork unit; and a movement control unit configured to control movement of the movable cart unit based on the anterior information.

9. The conveyance apparatus according to claim 8, further comprising:

a stepped portion detection unit configured to detect a stepped portion of the traveling surface based on the anterior information; and a stepped portion get-over control unit configured to control an operation of the distal end support mechanism and an operation of the auxiliary leg unit such that the movable cart unit gets over the stepped portion.

* * * * *